US010976129B1

(12) United States Patent
Timpson et al.

(10) Patent No.: US 10,976,129 B1
(45) **Date of Patent: *Apr. 13, 2021**

(54) ELECTROMAGNETIC DRIVER WITH HELICAL RAILS TO IMPART ROTATION

(71) Applicant: Honeywell Federal Manufacturing & Technologies, LLC, Kansas City, MO (US)

(72) Inventors: Erik Timpson, Kansas City, MO (US); Seth Hartman, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 233 days.

This patent is subject to a terminal disclaimer.

(21) Appl. No.: 16/232,588

(22) Filed: Dec. 26, 2018

(51) Int. Cl.
*H01F 7/08* (2006.01)
*F41B 6/00* (2006.01)

(52) U.S. Cl.
CPC ..... *F41B 6/003* (2013.01); *F41B 6/006* (2013.01)

(58) Field of Classification Search
CPC ..... F41B 6/006; F41B 6/003
USPC ..... 335/279
See application file for complete search history.

(56) References Cited

U.S. PATENT DOCUMENTS 5,182,254 A * 1/1993 Owens ..... F41B 6/006 124/3
5,183,956 A * 2/1993 Rosenberg ..... F41B 6/00 102/374
5,189,244 A 2/1993 Weldon
5,237,904 A 8/1993 Kuhlmann-Wilsdorf
5,431,083 A 7/1995 Vassioukevitch
(Continued)

FOREIGN PATENT DOCUMENTS

CN 1279391 10/2006
CN 201561694 8/2010
(Continued)

OTHER PUBLICATIONS

CN202209908 English Translation of Abstract; Full Translation not available.

(Continued)

*Primary Examiner* — Shawki S Ismail
*Assistant Examiner* — Lisa N Homza
(74) *Attorney, Agent, or Firm* — Hovey Williams LLP

(57) ABSTRACT

An EM driver for accelerating an object may be configured as an EM rifle for accelerating, rotating to spin-stabilize, and releasing a projectile. A core includes a stator coil, forward and reverse coils, a railed shaft, and a transfer shaft. The stator coil generates a first EM field, and the forward and reverse coils generate second and third EM fields which interact with the first EM field to accelerate the armature in forward and reverse directions, respectively. The railed shaft is elongated along a central axis through the armature and includes multiple rails arranged helically around a central shaft. The armature remains in contact with the rails during acceleration so as to impart a turning motion. The transfer shaft is physically coupled with and projects forwardly from the armature and transfers to the projectile the acceleration and the turning motion of the armature in the forward direction.

19 Claims, 20 Drawing Sheets

(56) References Cited

U.S. PATENT DOCUMENTS

| | | | | |
|---|---|---|---|---|
| 6,622,713 | B1 * | 9/2003 | Thomas | F41B 6/00 124/3 |
| 6,696,775 | B2 | 2/2004 | Engel | |
| 7,614,393 | B1 | 11/2009 | Lu | |
| 8,291,806 | B2 | 10/2012 | Rael | |
| 8,302,584 | B1 | 11/2012 | Lu | |
| 9,551,548 | B2 | 1/2017 | Izquierdo | |
| 10,082,360 | B2 | 9/2018 | Hartman et al. | |
| 2003/0137377 | A1 * | 7/2003 | Engel | H02K 41/0352 335/220 |
| 2013/0316308 | A1 * | 11/2013 | Monti | F41A 33/02 434/16 |
| 2017/0314887 | A1 * | 11/2017 | Engel | F41B 6/003 |
| 2017/0343314 | A1 * | 11/2017 | Hartman | F41B 6/006 |
| 2017/0346378 | A1 * | 11/2017 | Hartman | H02K 41/031 |

FOREIGN PATENT DOCUMENTS

| | | |
|---|---|---|
| CN | 202209908 | 5/2012 |
| CN | 102636087 | 8/2012 |
| CN | 105605969 | 5/2016 |
| WO | 2001031279 | 5/2001 |

OTHER PUBLICATIONS

CN105605969 English Translation of Abstract; Full Translation not available.

CN1279391 English Translation of Abstract; Full Translation not available.

CN201561694 English Translation of Abstract; Full Translation not available.

C102636087 English Translation of Abstract; Full Translation not available.

* cited by examiner

ELECTROMAGNETIC DRIVER WITH HELICAL RAILS TO IMPART ROTATION

STATEMENT REGARDING FEDERALLY-SPONSORED RESEARCH OR DEVELOPMENT

This invention was made with government support under Contract No.: DE-NA0000622 awarded by the Department of Energy. The government has certain rights in the invention.

FIELD

The present invention relates to systems and methods using electromagnetic fields to drive objects, and more particularly, embodiments concern an electromagnetic driver for accelerating an object, such as a projectile, wherein the electromagnetic driver includes helical rails to impart rotation to the object and forward and reverse coils to reset the EM driver.

BACKGROUND

Electromagnetic (EM) propulsion employs electrical currents and magnetic fields to accelerate objects. Electrical current may be used either to create an opposing magnetic field or to charge a field which can then be repelled. Several devices have been developed which utilize these principles, including railguns, coilguns or Gauss guns, and helical railguns.

A railgun is a device that uses EM propulsion to launch high velocity projectiles. A sliding armature is accelerated along a pair of parallel conductors, or rails, by the EM effects of a pulsed DC current that flows down one rail, into the armature, and then back along the other rail. When a conductive projectile is inserted between the rails, it completes the circuit so that current flows from the negative terminal of the power supply, up the negative rail, across the projectile, and down the positive rail, back to the power supply. This current makes the railgun behave as an electromagnet, creating a magnetic field inside the loop formed by the length of the rails and the armature. In accordance with the right-hand rule, the magnetic field circulates around each conductor. Because the current is in the opposite direction along each rail, the net magnetic field between the rails is directed at right angles to the plane formed by the central axes of the rails and the armature. In combination with the current in the armature, this produces a Lorentz force which accelerates the projectile along the rails and out of the loop.

A coilgun or Gauss gun is another device that uses EM propulsion to launch high velocity projectiles. One or more coils function as electromagnets in the configuration of a linear motor that accelerates a ferromagnetic or conducting projectile. Generally, coilguns have one or more coils arranged along an axis. The coils are switched on and off in a precisely timed sequence, causing the projectile to be accelerated quickly through the barrel via magnetic forces. While some simple coilguns use ferromagnetic projectiles or even permanent magnet projectiles, most use a coupled coil as part of the projectile. For ferromagnetic projectiles, a single stage coilgun can be formed by a coil of wire forming an electromagnet, with a ferromagnetic projectile placed at one of its ends. A large current is pulsed through the coil of wire and a strong magnetic field forms, pulling the projectile to the center of the coil. When the projectile nears this point, the electromagnet is switched off to prevent the projectile from being trapped at the center of the electromagnet. In a multistage design, additional electromagnets are used to repeat this process and thereby progressively accelerate the projectile. Power is supplied to the electromagnet by a fast discharge storage device (e.g., one or more capacitors).

Coilguns are distinct from railguns, as the direction of acceleration in a railgun is at right angles to the central axis of the current loop formed by the conducting rails. In addition, railguns usually require the use of sliding contacts to pass a large current through the projectile, but coilguns do not necessarily require sliding contacts. Railguns suffer from several disadvantages, including that they require very high levels of electrical current and use relatively low voltages, which makes them inefficient. Coilguns also suffer from several disadvantages, including that as the projectile moves the magnetic fields decouple which causes the projectile to stop moving.

A helical railgun, or helical coil launcher, combines features of railguns and coilguns. Two rails are surrounded by a helical barrel, and the projectile is energized continuously by two brushes sliding along the rails, and two or more additional brushes on the projectile serve to energize and commute several windings of the helical barrel direction in front of and/or behind the projectile.

This background discussion is intended to provide information related to the present invention which is not necessarily prior art.

SUMMARY

Embodiments of the present invention address the above-described and other problems and limitations in the prior art by providing an EM driver for accelerating an object, such as a projectile, wherein the EM driver includes helical rails to impart rotation to the object and forward and reverse coils to reset the EM driver.

In a first embodiment, an EM driver is provided for accelerating an object and including helical rails to impart rotation to the accelerating object. The EM driver may include a body and a core. The body may be elongated along a central axis. The core may be housed within the body and configured to accelerate the object along the central axis, and may include a stator, an armature, and a railed shaft. The stator may include a stator coil configured to generate a first EM field. The armature may include a forward coil configured to generate a second EM field which interacts with the first EM field to accelerate the armature in a forward direction along the central axis. The railed shaft may be elongated along the central axis and pass through the armature and include a plurality of rails arranged helically around a central shaft, wherein the forward coil remains in physical contact with one or more of the plurality of rails during acceleration of the armature in the forward direction, so as to impart a turning motion to the armature during acceleration in the forward direction.

In various implementations, the first embodiment may include any one or more of the following features. The object may be accelerated and released, and may be a package, a payload, a vehicle, or a projectile. The object may be accelerated and not released, and may be a hammer, a chisel, an impactor, or a piston. The stator coil may be a cylindrical coil of wire elongated along the central axis. The EM driver may further include a transfer shaft physically coupled with the armature and project forwardly therefrom along the central axis and be configured to transfer to the object the acceleration of the armature in the forward direction. The forward end of the transfer shaft may include one or more mechanical structures configured to physically engage the object and thereby further transfer to the object the turning motion of the armature. The EM driver may further include a transfer plate physically coupled with a forward end of the transfer shaft and configured to transfer to the object the acceleration of the armature and the transfer shaft in the forward direction. The transfer plate may include one or more mechanical structures configured to physically engage the object and thereby further transfer to the object the turning motion of the armature.

The EM driver may further include a first contact ring at a first end of the forward coil and a second contact ring at a second end of the forward coil, wherein the first and second contact rings may remain in physical contact with one or more of the plurality of rails during acceleration of the armature in the forward direction. During forward operation, an electrical current may be applied to a first rail of the plurality of rails and then travel from the first rail to the first contact point, from the first contact point to the forward coil, from the forward coil to the second contact ring, from the second contact ring to the stator coil, from the stator coil to the first contact ring, from the first contact ring to the armature pass-through, and from the armature pass-through to a third rail of the plurality of rails, thereby completing an electrical circuit, and as a result, the armature is accelerated in the forward direction as the second EM field attempts to align with the first EM field. The EM driver may further include a reverse coil configured to generate a third EM field which interacts with the first EM field to accelerate the armature in a rearward direction along the central axis. During rearward operation, the electrical current may be applied to a second rail of the plurality of rails and then travel from the second rail to the second contact point, from the second contact point to the reverse coil, from the reverse coil to the first contact ring, from the first contact ring to the stator coil, from the stator coil to the second contact ring, from the second contact ring to the armature pass-through, and from the armature pass-through to a fourth rail of the plurality of rails, thereby completing the electrical circuit, and as a result, the armature is accelerated in the rearward direction as the third EM field attempts to align with the first EM field. The EM driver may further include first and second forward contact rings electrically connected to the forward coil, wherein the first and second forward contact rings remain in physical contact with one or more of the plurality of rails during acceleration of the armature in the forward direction, and first and second rearward contact rings electrically connected to the reverse coil, wherein the first and second rearward contact rings remain in physical contact with one or more of the plurality of rails during acceleration of the armature in the rearward direction.

In a second embodiment, an EM driver is provided for accelerating an object and including both forward and reverse coils. The EM driver may include a body and a core. The body may be elongated along a central axis. The core may be housed within the body and configured to accelerate the object along the central axis, and may include a stator and an armature having a forward coil, a reverse coil, and first and second contact rings. The stator may include a stator coil configured to generate a first EM field. The forward coil may be configured to generate a second EM field which interacts with the first EM field to accelerate the armature in a forward direction along the central axis. The reverse coil may be configured to generate a third EM field which interacts with the first EM field to accelerate the armature in a rearward direction along the central axis. The first contact ring may be located at a first end of the forward coil and a first end of the reverse coil, and the second contact ring may be located at a second end of the forward coil and at a second end of the reverse coil.

In various implementations, the second embodiment may further include any one or more of the following features. The EM driver may further include a railed shaft elongated along the central axis and passing through the armature and including a plurality of rails arranged helically around a central shaft, wherein each of the first and second contact rings, the forward coil, and the reverse coil remain in physical contact with one or more of the plurality of rails during acceleration of the armature in the forward and rearward directions, so as to impart a turning motion to the armature during acceleration in the forward and rearward directions. The object may be accelerated and released, and may be a package, a payload, a vehicle, or a projectile. The object may be accelerated and not released, and may be a hammer, a chisel, an impactor, or a piston. The stator coil may be a cylindrical coil of wire elongated along the central axis. The EM driver may further include a transfer shaft physically coupled with the armature and projecting forwardly therefrom along the central axis and configured to transfer to the object the acceleration of the armature in the forward direction. A forward end of the transfer shaft may include one or more mechanical structures configured to physically engage the object and thereby further transfer to the object a turning motion of the armature. The EM driver may further include a transfer plate physically coupled with a forward end of the transfer shaft and configured to transfer to the object the acceleration of the armature and the transfer shaft in the forward direction. The transfer plate may include one or more mechanical structures configured to physically engage the object and thereby further transfer to the object a turning motion of the armature.

During forward operation, an electrical current may be applied to a first rail of the plurality of rails and then travel from the first rail to the first contact point, from the first contact point to the forward coil, from the forward coil to the second contact ring, from the second contact ring to the stator coil, from the stator coil to the first contact ring, from the first contact ring to the armature pass-through, and from the armature pass-through to a third rail of the plurality of rails, thereby completing an electrical circuit, and as a result, the armature is accelerated in the forward direction as the second EM field attempts to align with the first EM field. During rearward operation, the electrical current may be applied to a second rail of the plurality of rails and then travel from the second rail to the second contact point, from the second contact point to the reverse coil, from the reverse coil to the first contact ring, from the first contact ring to the stator coil, from the stator coil to the second contact ring, from the second contact ring to the armature pass-through, and from the armature pass-through to a fourth rail of the plurality of rails, thereby completing the electrical circuit, and as a result, the armature is accelerated in the rearward direction as the third EM field attempts to align with the first EM field. The EM driver may further include first and second forward contact rings electrically connected to the forward coil, wherein the first and second forward contact rings remain in physical contact with one or more of the plurality of rails during acceleration of the armature in the forward direction, and first and second rearward contact rings electrically connected to the reverse coil, wherein the first and second rearward contact rings remain in physical contact with one or more of the plurality of rails during acceleration of the armature in the rearward direction.

In a third embodiment, an EM rifle is provided for accelerating, imparting a rotation to spin-stabilize, and releasing a projectile. The EM rifle may include a body and a core. The body may be elongated along a central axis. The core may be housed within the body and configured to accelerate the projectile along the central axis, and may include a stator; an armature having a forward coil, a reverse coil, and first and second contact rings; a railed shaft; and a transfer shaft. The stator may include a stator coil configured to generate a first EM field. The forward coil may be configured to generate a second EM field which interacts with the first EM field to accelerate the armature in a forward direction along the central axis. The reverse coil may be configured to generate a third EM field which interacts with the first EM field to accelerate the armature in a rearward direction along the central axis. The first contact ring may be located at a first end of the forward coil and a first end of the reverse coil, and the second contact ring may be located at a second end of the forward coil and a second end of the reverse coil. The railed shaft may be elongated along the central axis and pass through the armature, and may include a plurality of rails arranged helically around a central shaft, wherein each the first and second contact rings, the forward coil, and the reverse coil remain in physical contact with one or more of the plurality of rails during acceleration of the armature in the forward and rearward directions so as to impart a turning motion to the armature during acceleration in the forward and rearward directions. The transfer shaft may be physically coupled with the armature and project forwardly therefrom along the central axis and configured to transfer to the projectile the acceleration and the turning motion of the armature in the forward direction.

In various implementations, the third embodiment may further include any one or more of the following features. The EM rifle may further include a stock attached to a rear portion of the body and configured to facilitate stabilizing the EM driver during use; a grip attached to the body and configured to facilitate holding the EM rifle during use; a handle attached to a side portion of the body and configured to facilitate handling the EM rifle during use; and a trigger associated with the grip and actuatable to initiate accelerating and releasing the projectile. The stator coil may be a cylindrical coil of wire elongated along the central axis. The EM rifle may further include a feed mechanism configured to store a plurality of the projectiles and to deliver each projectile to the armature for individual acceleration. The body may include an opening which is uncovered when the armature is in a fully rearward position, and the feed mechanism delivers each projectile to the armature via the opening. The EM rifle may further include a power source located in a backpack and configured to provide the electrical current to the stator and armature coils. A forward end of the transfer shaft may include one or more mechanical structures configured to physically engage the projectile and thereby transfer to the projectile the turning motion of the armature. The EM rifle may further include a transfer plate physically coupled with a forward end of the transfer shaft and configured to transfer to the projectile the acceleration of the armature and the transfer shaft in the forward direction. The transfer plate may include one or more mechanical structures configured to physically engage the projectile and thereby transfer to the projectile the turning motion of the armature.

During forward operation, an electrical current may be applied to a first rail of the plurality of rails and then travel from the first rail to the first contact point, from the first contact point to the forward coil, from the forward coil to the second contact ring, from the second contact ring to the stator coil, from the stator coil to the first contact ring, from the first contact ring to the armature pass-through, and from the armature pass-through to a third rail of the plurality of rails, thereby completing an electrical circuit, and as a result, the armature is accelerated in the forward direction as the second EM field attempts to align with the first EM field. During rearward operation, the electrical current may be applied to a second rail of the plurality of rails and then travel from the second rail to the second contact point, from the second contact point to the reverse coil, from the reverse coil to the first contact ring, from the first contact ring to the stator coil, from the stator coil to the second contact ring, from the second contact ring to the armature pass-through, and from the armature pass-through to a fourth rail of the plurality of rails, thereby completing the electrical circuit, and as a result, the armature is accelerated in the rearward direction as the third EM field attempts to align with the first EM field. The EM driver may further include first and second forward contact rings electrically connected to the forward coil, wherein the first and second forward contact rings remain in physical contact with one or more of the plurality of rails during acceleration of the armature in the forward direction, and first and second rearward contact rings electrically connected to the reverse coil, wherein the first and second rearward contact rings remain in physical contact with one or more of the plurality of rails during acceleration of the armature in the rearward direction.

This summary is not intended to identify essential features of the present invention, and is not intended to be used to limit the scope of the claims. These and other aspects of the present invention are described below in greater detail.

DRAWINGS

Embodiments of the present invention are described in detail below with reference to the attached drawing figures, wherein.

DETAILED DESCRIPTION

Figure 1:
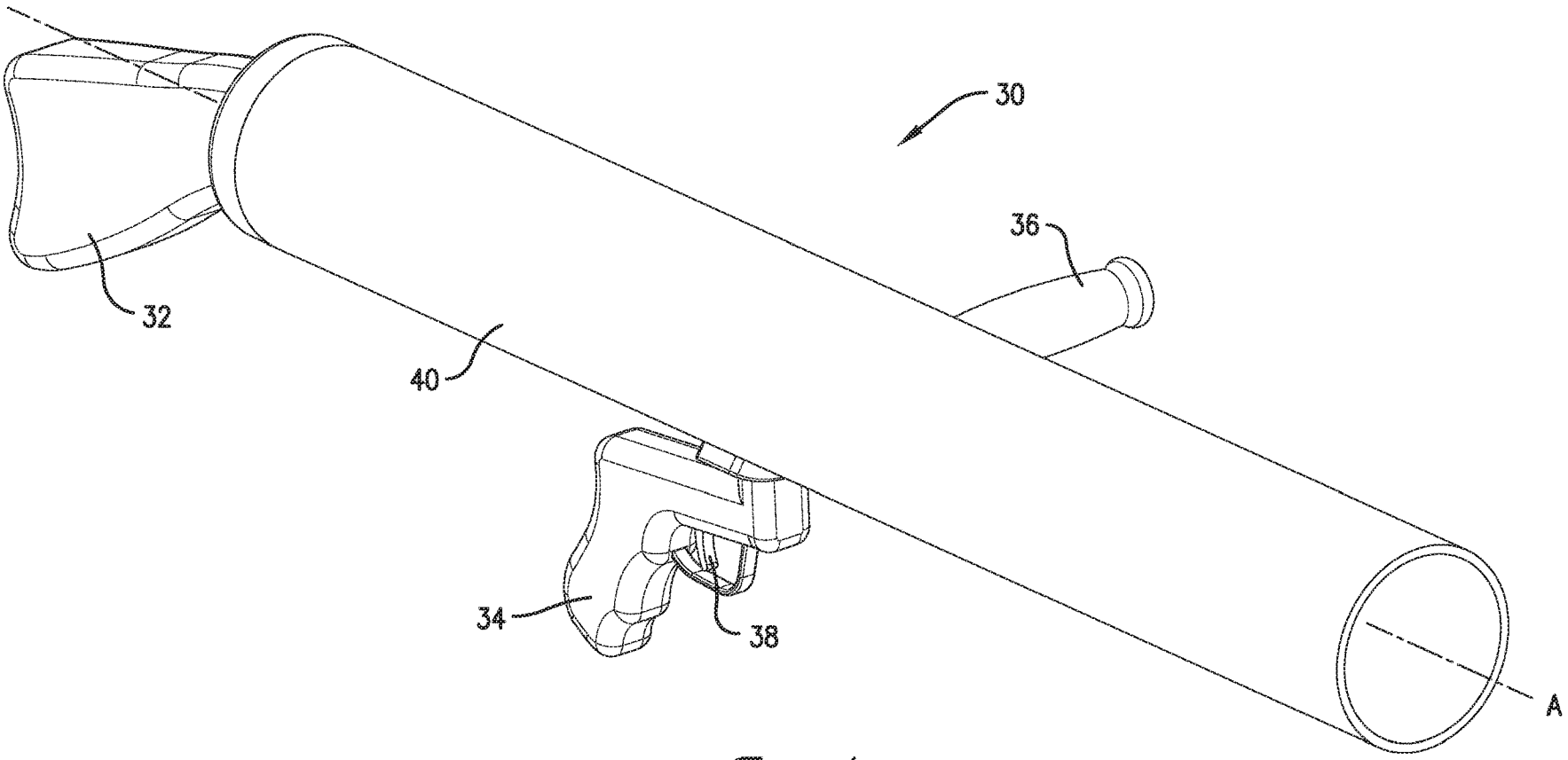
FIG. 1 is a rearward-looking isometric view of an embodiment of an EM driver in the form of an EM rifle.
Figure 2:
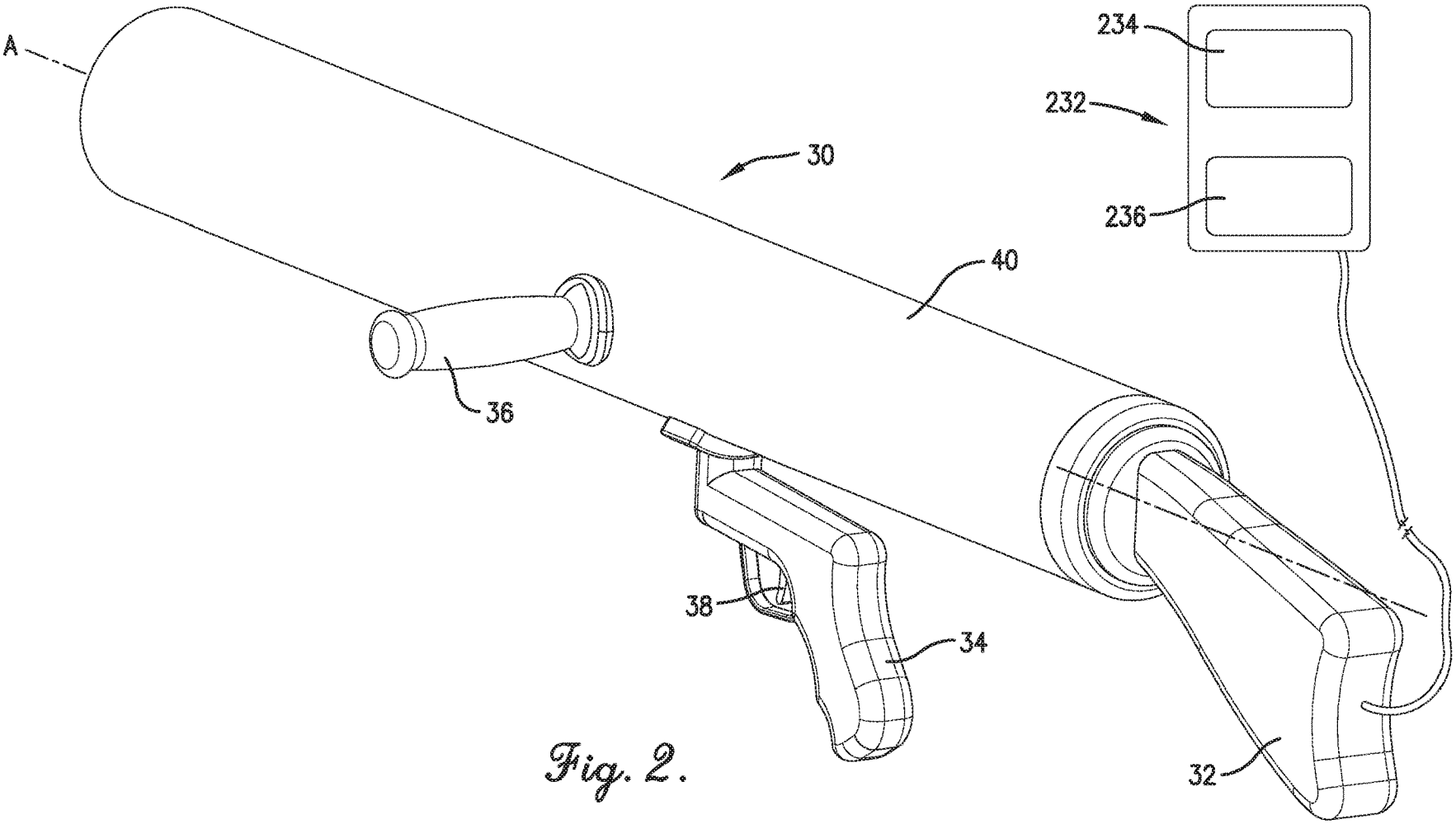
FIG. 2 is a forward-looking isometric view of the EM rifle of FIG. 1, also showing an optional backpack power supply and/or ammunition reservoir.
Figure 3:
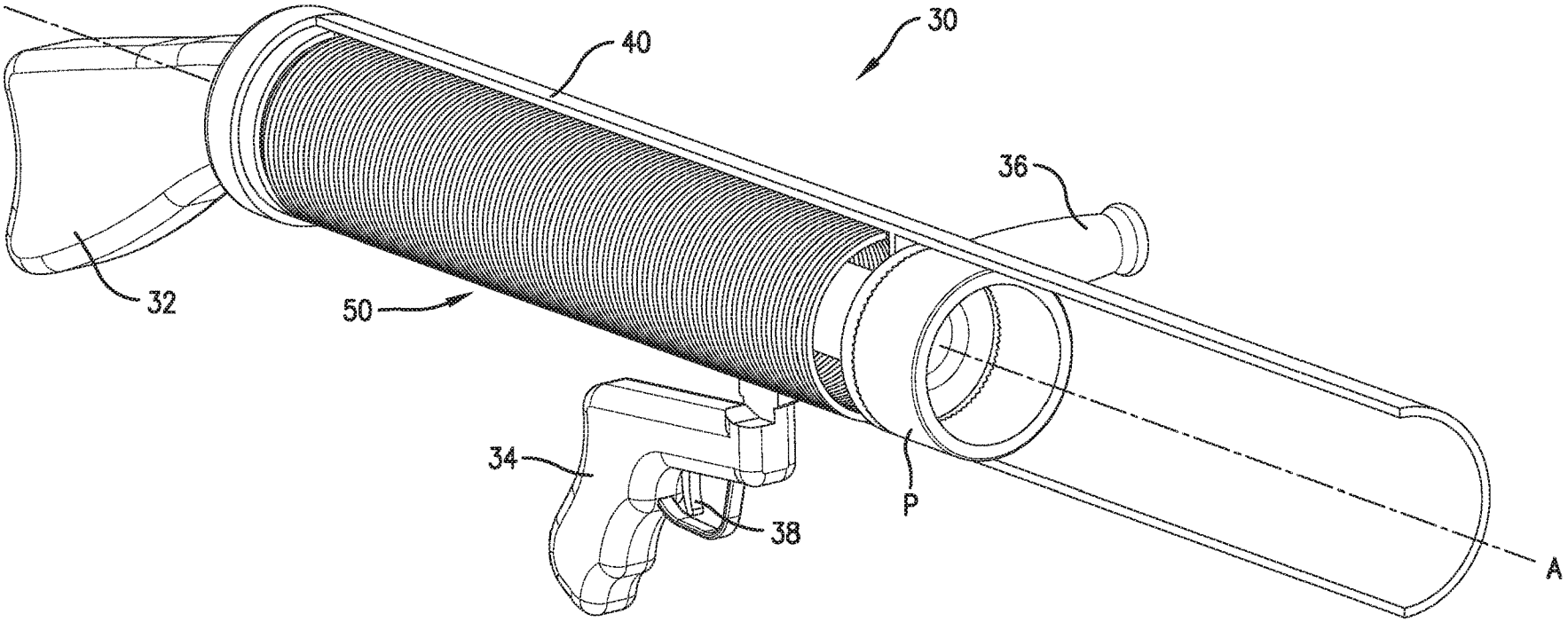
FIG. 3 is a first rearward-looking partial cross-sectional isometric view of the EM rifle of FIG. 1, wherein a portion of a body is removed to show a stator.
Figure 4:
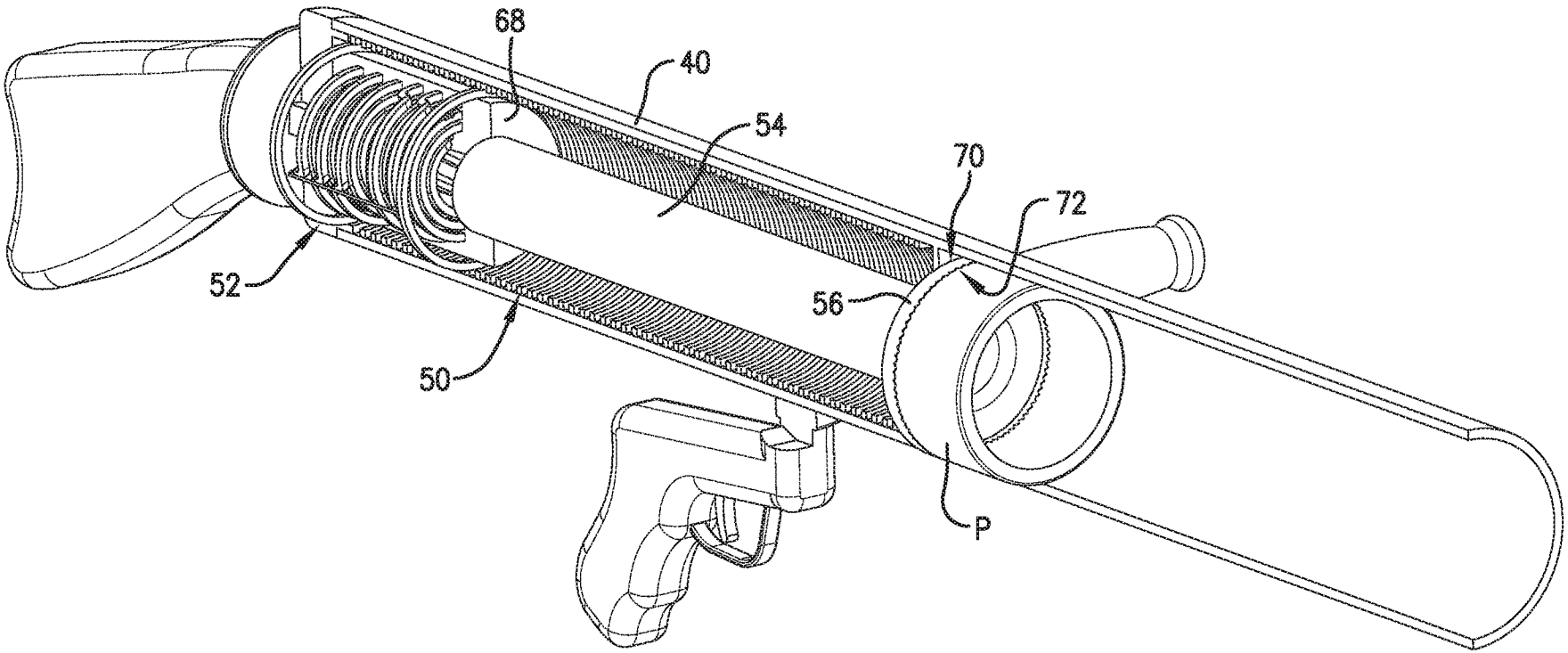
FIG. 4 is a second rearward-looking partial cross-sectional isometric view of the EM rifle of FIG. 3, wherein a portion of the stator is removed to show an armature.
Figure 5:
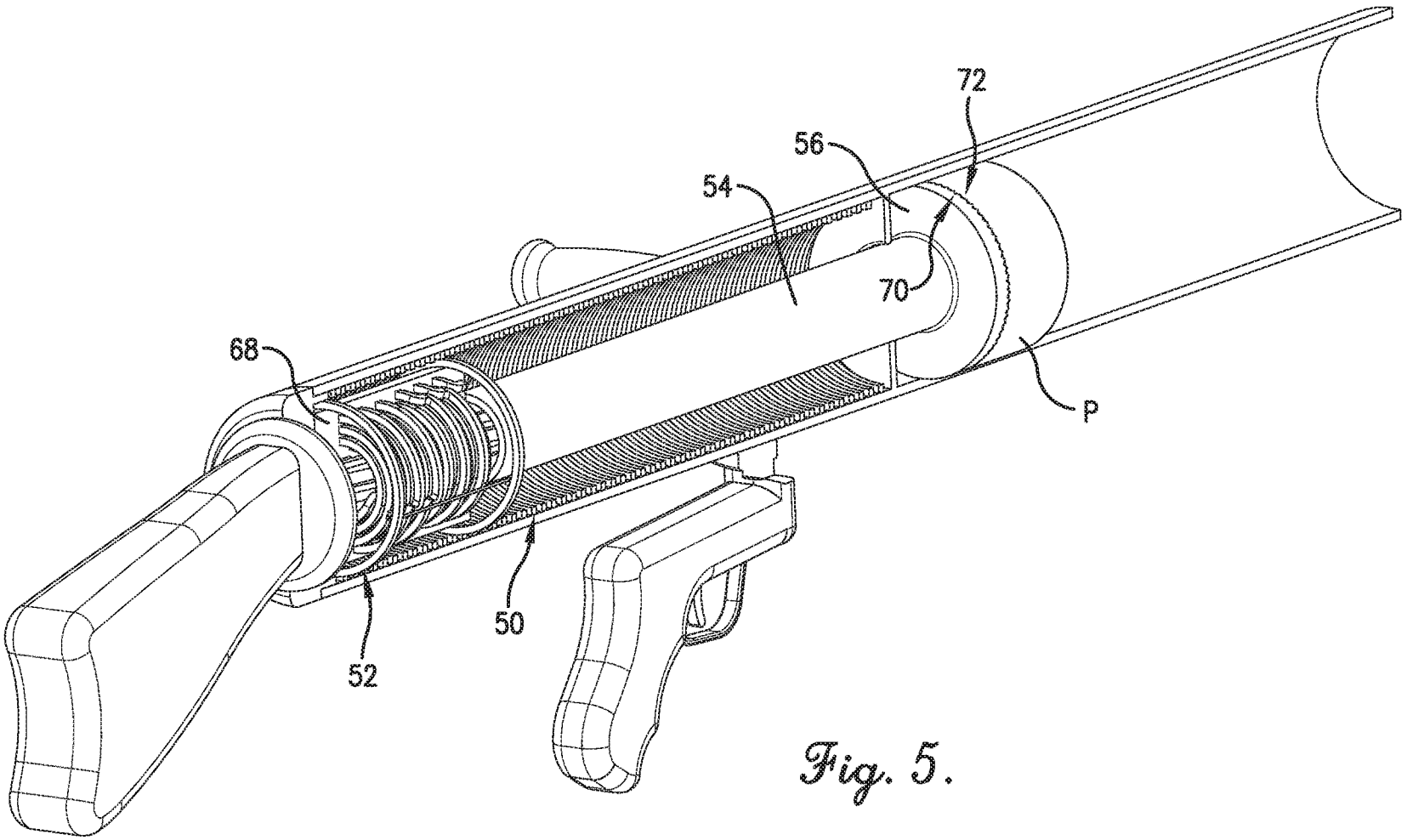
FIG. 5 is a forward-looking partial cross-sectional isometric view of the EM rifle of FIG. 4.
Figure 6:
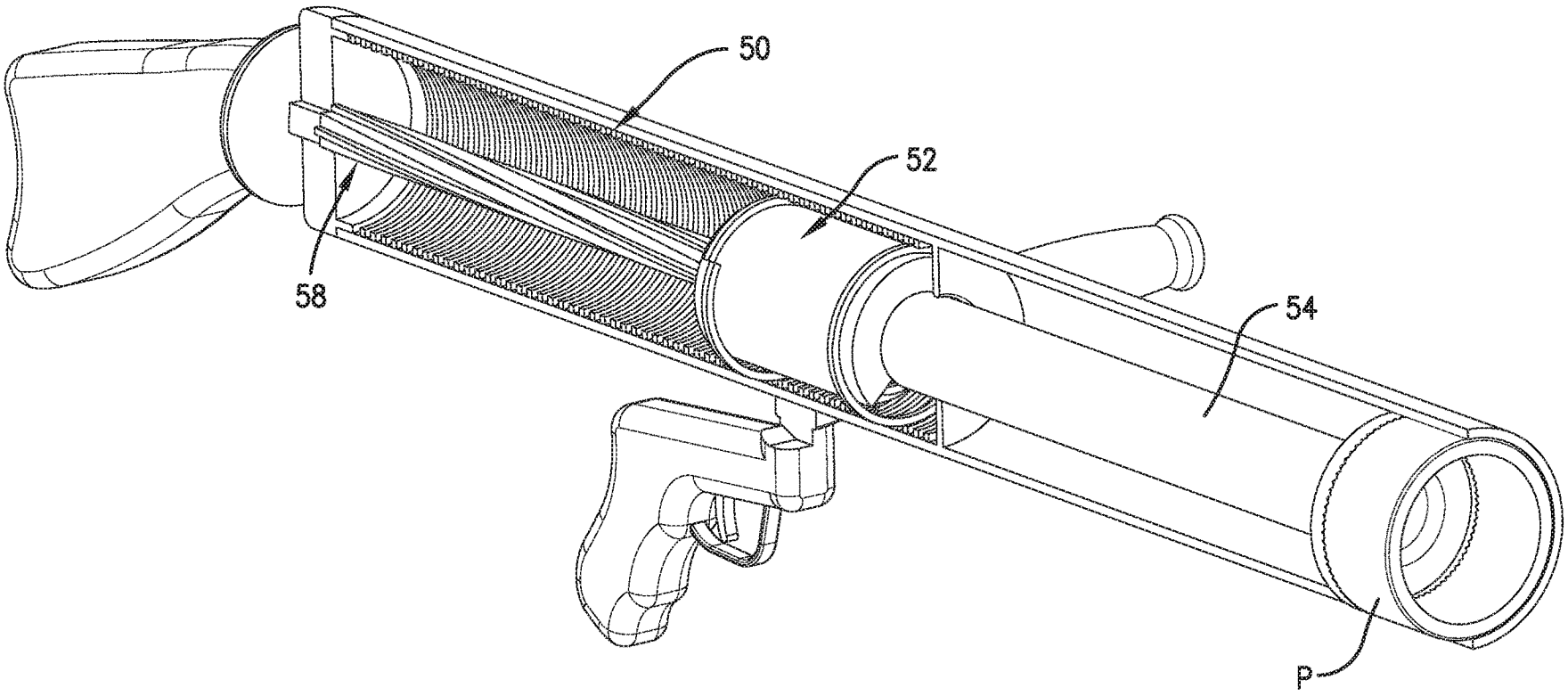
FIG. 6 is a third rearward-looking partial cross-sectional isometric view of the EM rifle of FIG. 4, wherein the armature is shown in a forward position to show a railed shaft.
Figure 7:
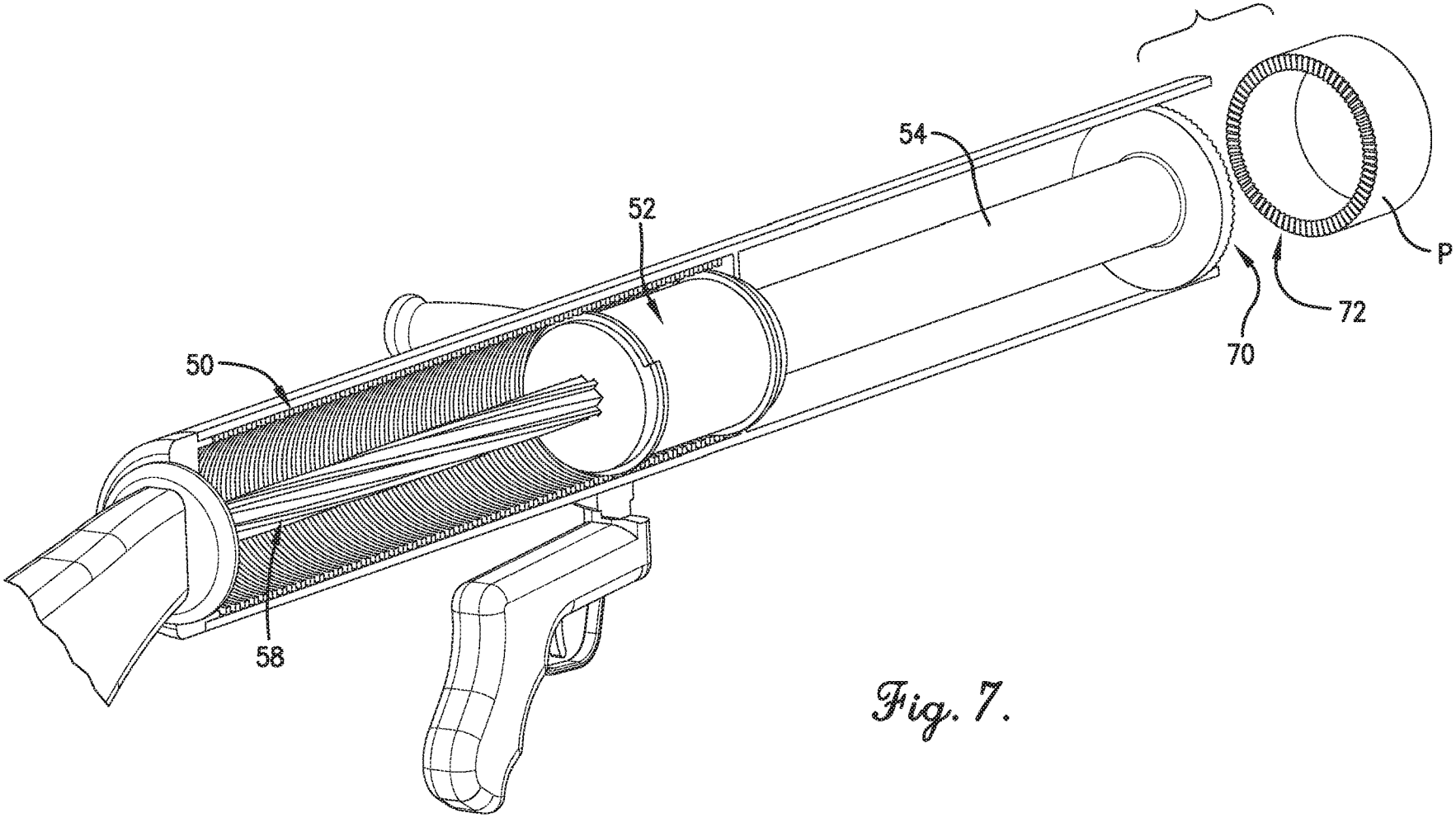
FIG. 7 is a forward-looking fragmentary partial cross-sectional isometric view of the EM rifle of FIG. 6, wherein a projectile is shown accelerated and released from the EM rifle.
Figure 8:
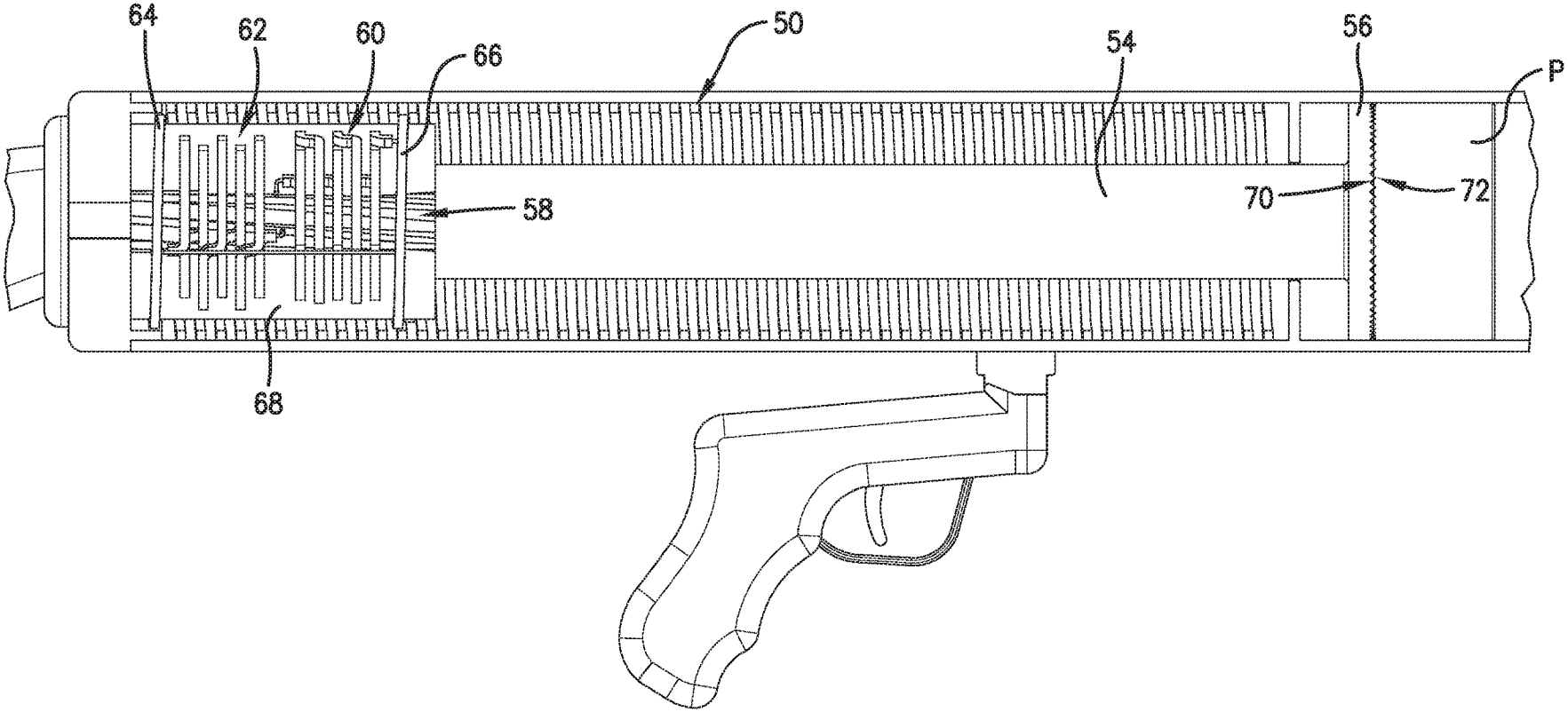
FIG. 8 is a fragmentary partial cross-sectional side elevation view of the EM rifle of FIG. 4.
Figure 9:
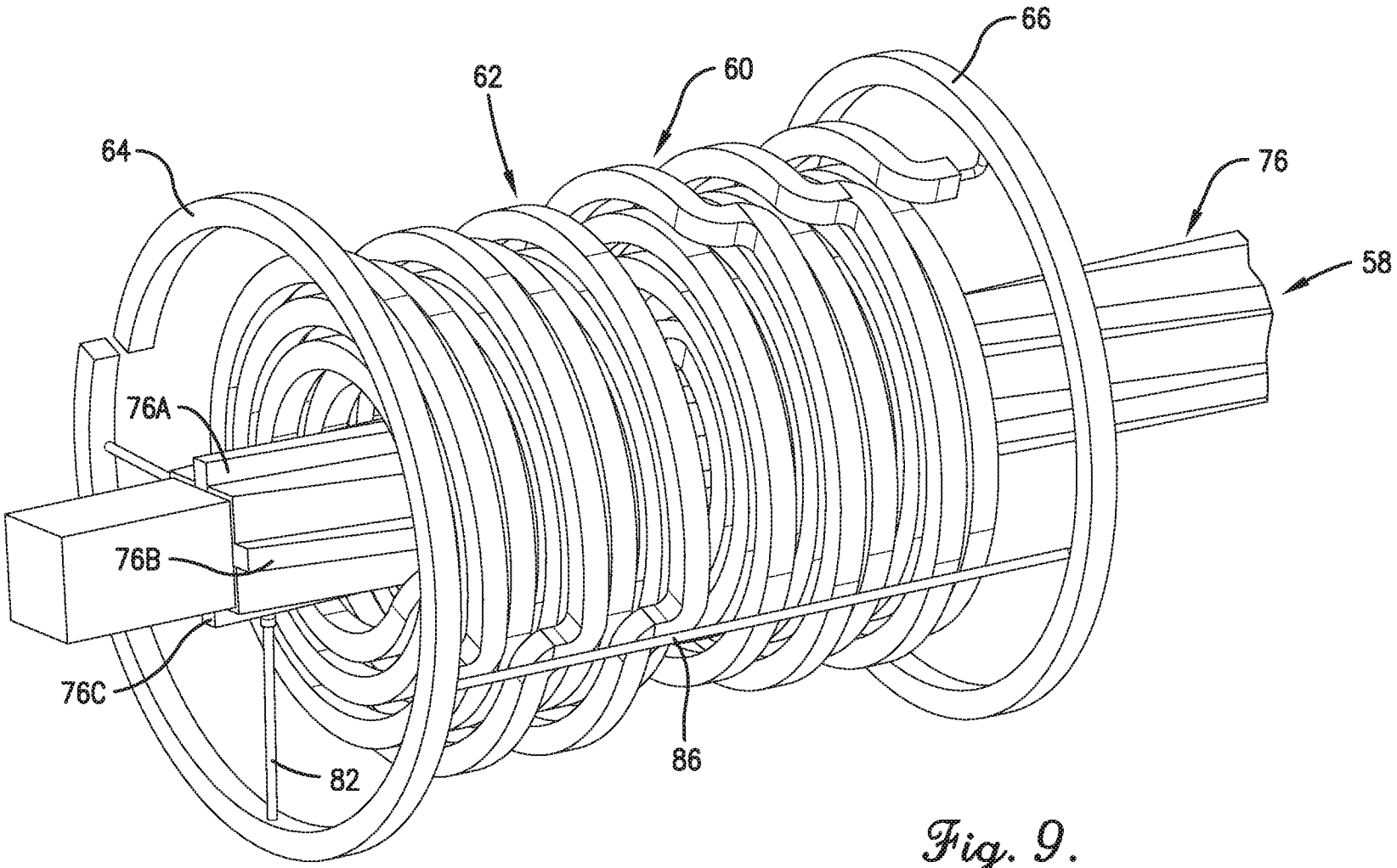
FIG. 9 is a fragmentary forward-looking isometric view of the armature and a transfer shaft.
Figure 10:
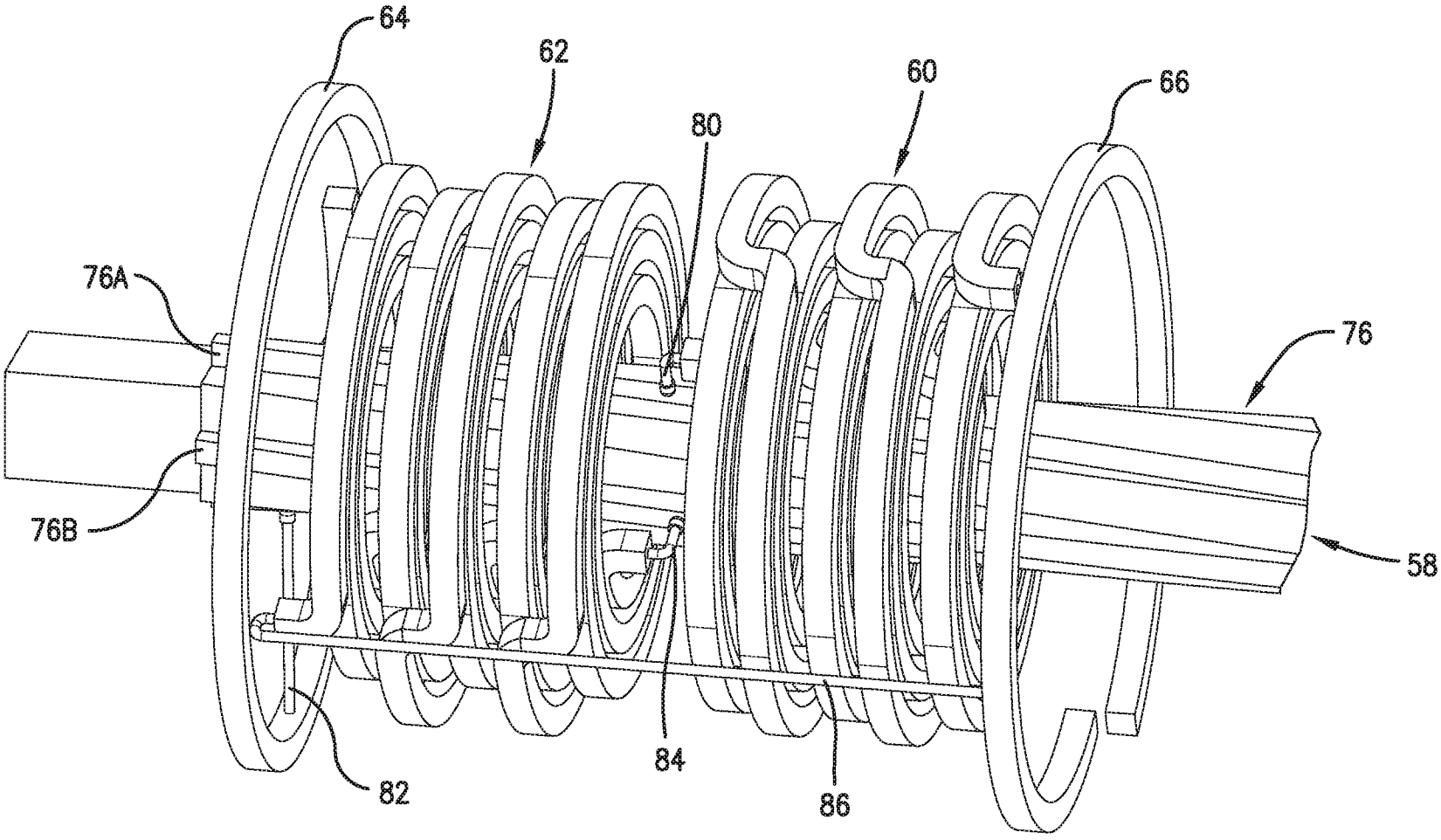
FIG. 10 is a fragmentary perspective view of the armature and transfer shaft of FIG. 9.
Figure 11:
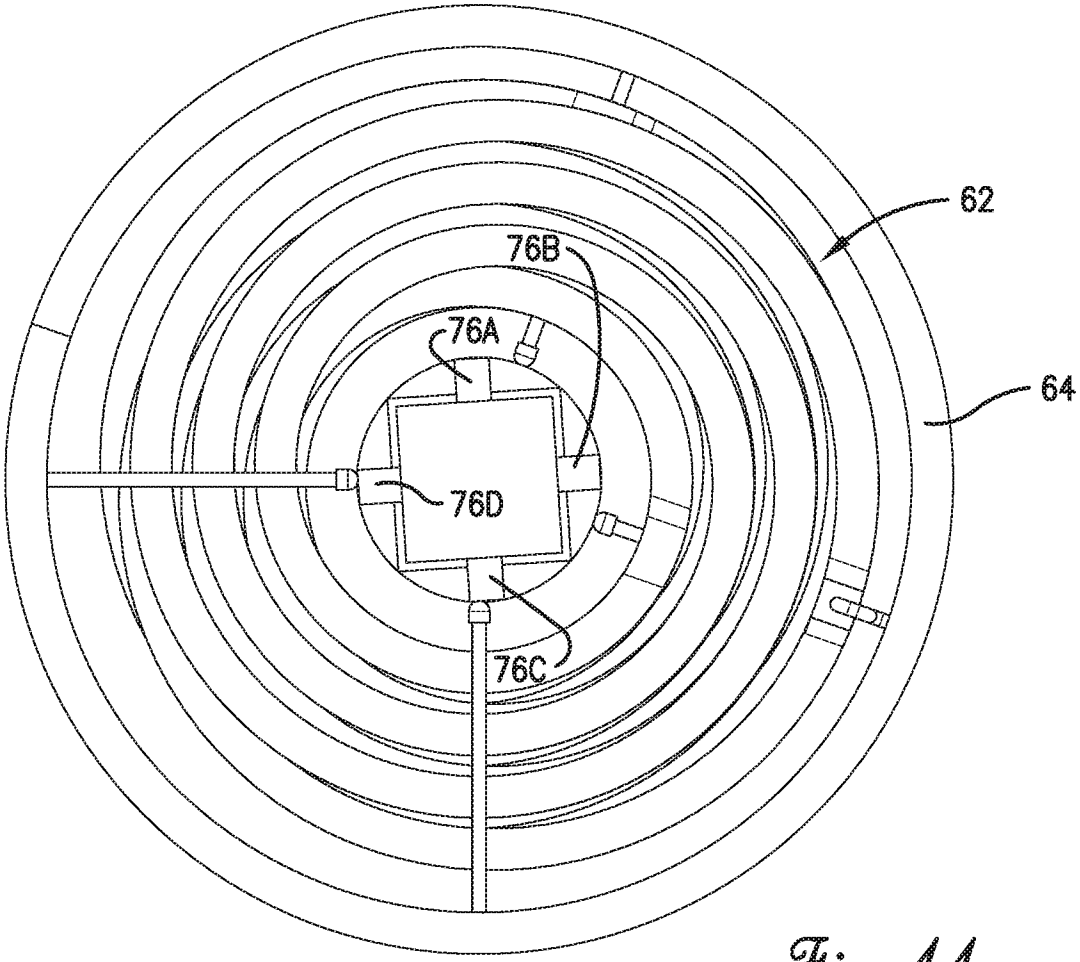
FIG. 11 is a rear elevation view of the armature and transfer shaft of FIG. 9.
Figure 12:
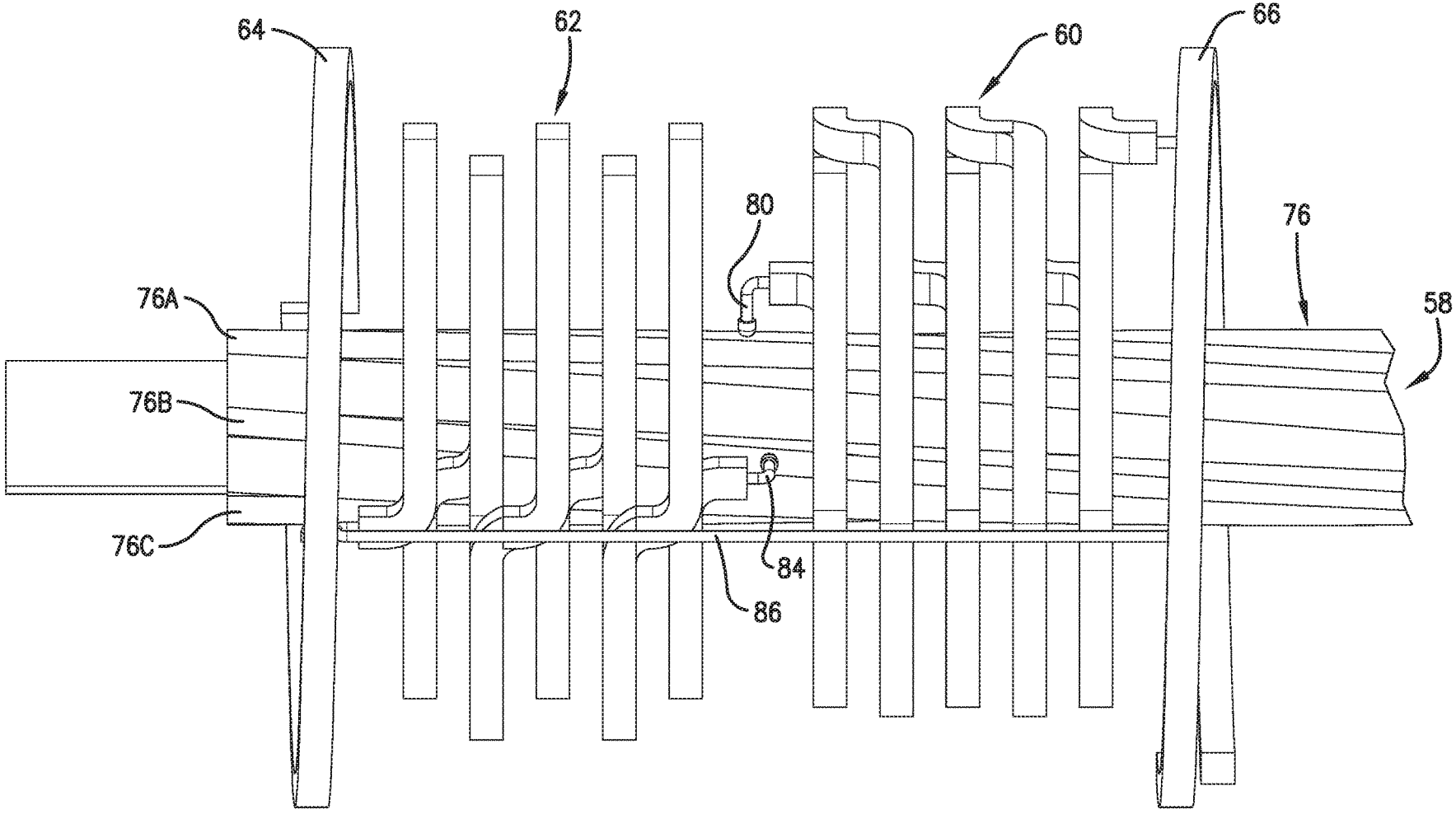
FIG. 12 is a fragmentary side elevation view of the armature and transfer shaft of FIG. 9.
Figure 13:
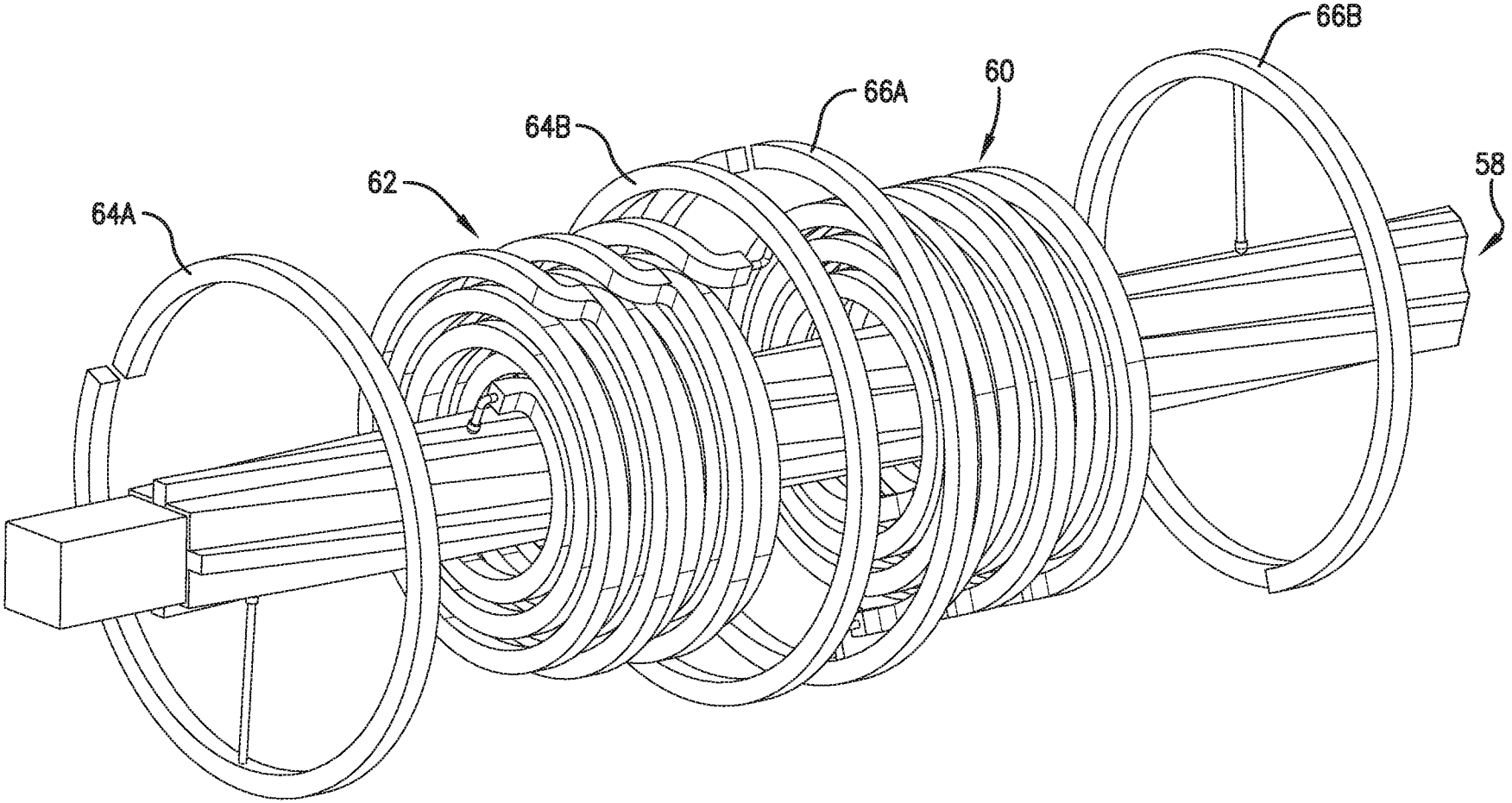
FIG. 13 is a fragmentary forward-looking isometric view of an alternative embodiment of the armature.
Figure 14:
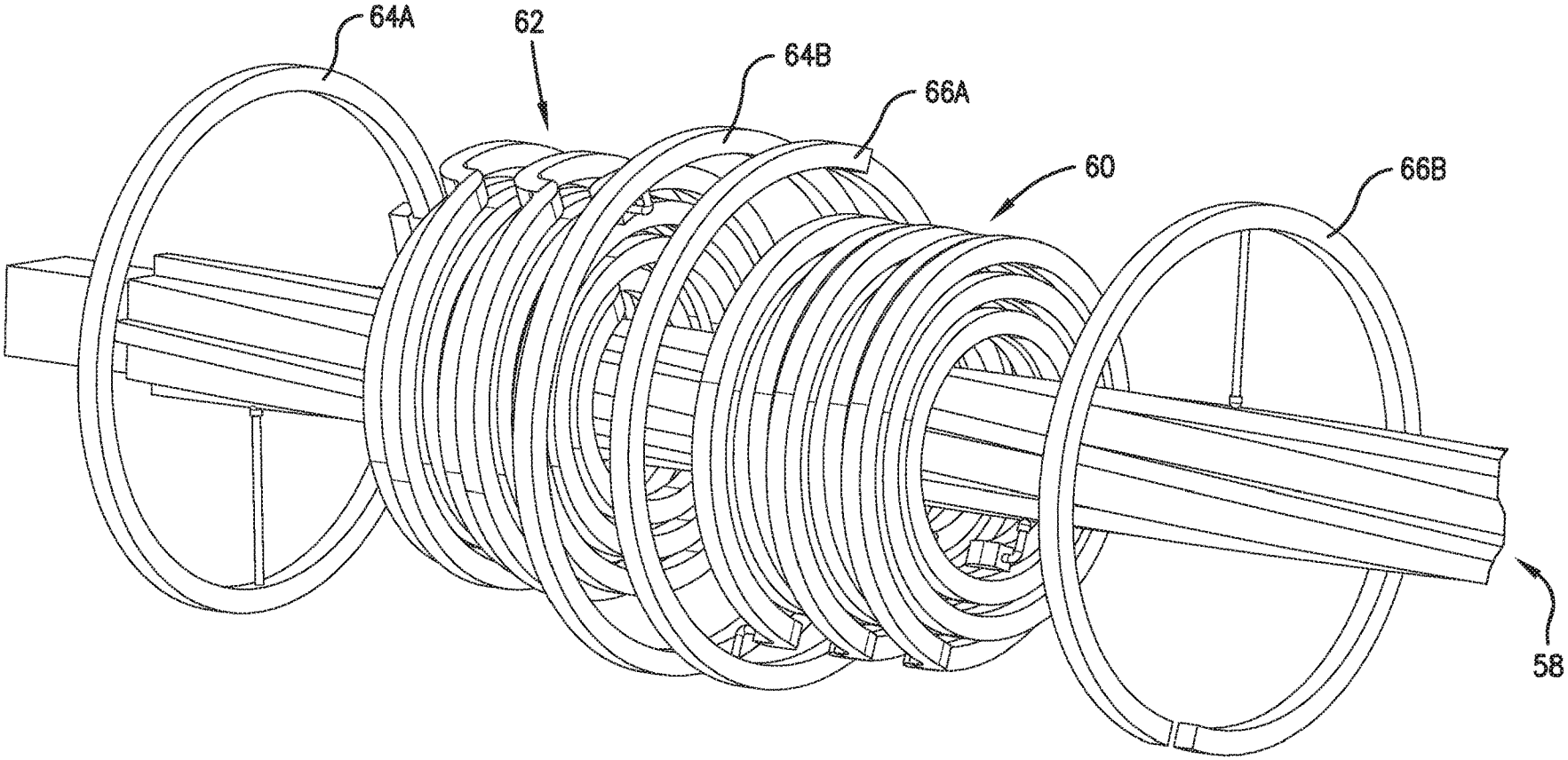
FIG. 14 is a fragmentary rearward-looking isometric view of the armature of FIG. 13.
Figure 15:
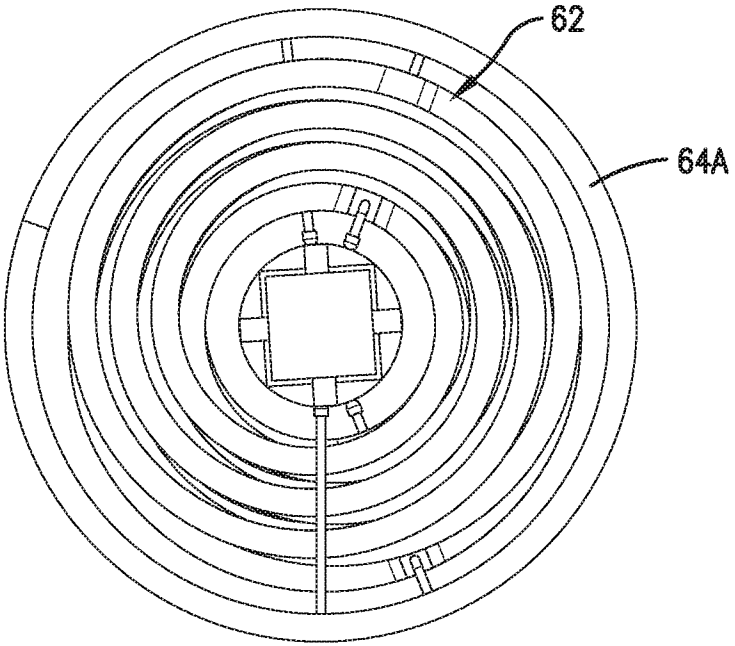
FIG. 15 is a rear elevation view of the armature of FIG. 13.
Figure 16:
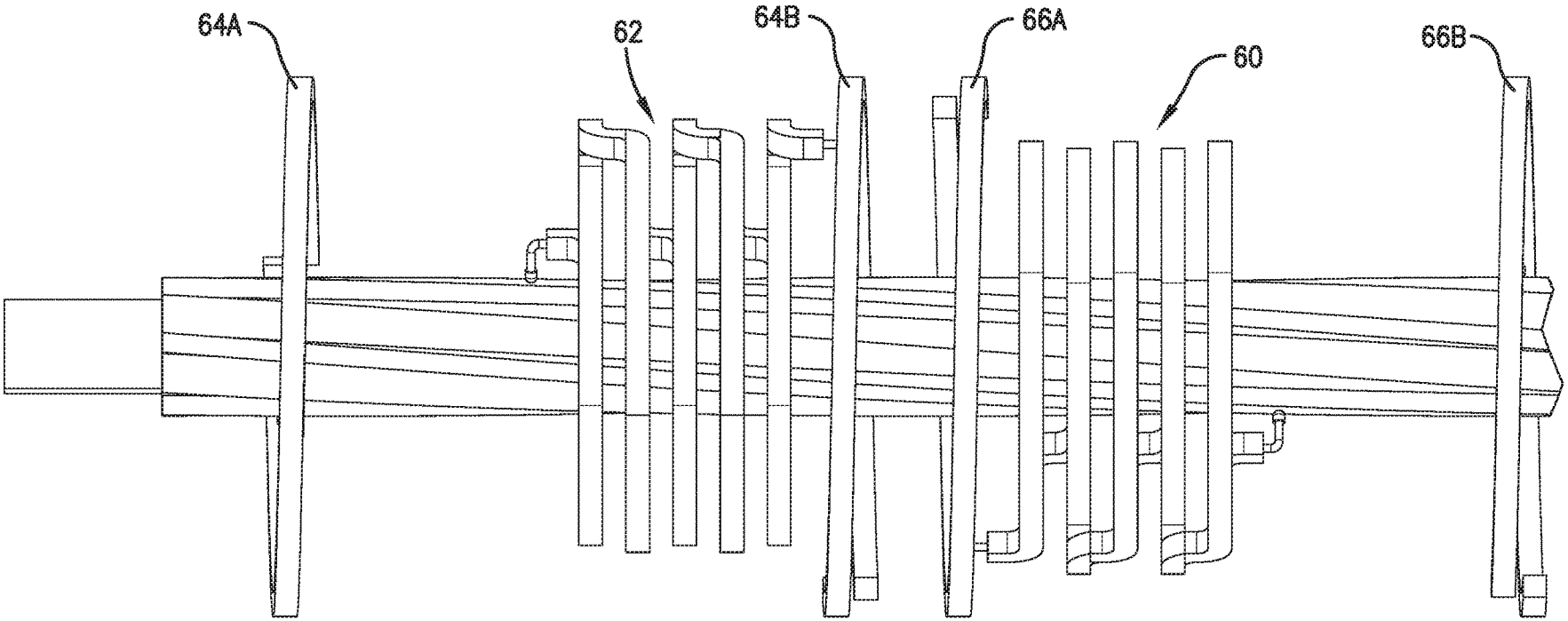
FIG. 16 is a fragmentary side elevation view of the armature of FIG. 13.

The following detailed description of embodiments of the invention references the accompanying figures. The embodiments are intended to describe aspects of the invention in sufficient detail to enable those with ordinary skill in the art to practice the invention. Other embodiments may be utilized and changes may be made without departing from the scope of the claims. The following description is, therefore, not limiting. The scope of the present invention is defined only by the appended claims, along with the full scope of equivalents to which such claims are entitled.

In this description, references to "one embodiment", "an embodiment", or "embodiments" mean that the feature or features referred to are included in at least one embodiment of the invention. Separate references to "one embodiment", "an embodiment", or "embodiments" in this description do not necessarily refer to the same embodiment and are not mutually exclusive unless so stated. Specifically, a feature, structure, act, etc. described in one embodiment may also be included in other embodiments, but is not necessarily included. Thus, particular implementations of the present invention can include a variety of combinations and/or integrations of the embodiments described herein.

Broadly, embodiments provide an EM driver for accelerating an object, wherein the EM driver includes helical rails to impart rotation to the object and forward and reverse coils to reset the EM driver. In a first embodiment, the EM driver may be configured to accelerate the object and include the helical rails to impart rotation to the accelerating object. In a second embodiment, the EM driver may be configured to accelerate the object and include both forward and reverse coils. In a third embodiment, the EM driver may take the form of an EM rifle configured to accelerate and release a projectile and impart a rotation to spin-stabilize the projectile. It will be understood that the object may be substantially any suitable object (e.g., an impactor such as a hammer, chisel, or other tool; a piston or other slug of material; a package or other payload; a vehicle; a projectile). In some implementations, it may be desirable to accelerate and release the object (e.g., a package or projectile), while in other implementations, it may be desirable to accelerate and retain the object (e.g., a hammer or chisel). Thus, although the third embodiment of an EM rifle is described herein for illustration purposes, it will be understood that the EM driver technology has broad application.

Referring to FIGS. 1-8, an embodiment of the EM rifle 30 may include a stock 32, a grip 34, a handle 36, a trigger 38, a body 40, and a core 42. The stock 32 may be configured to facilitate stabilizing the EM rifle 30 during use, and may employ fixed, folding, collapsible, or substantially any other conventional or non-conventional stock technology. In one implementation, the stock 32 may take the form of a shoulder-adapted component projecting generally axially or angularly from a rear of the body 40. The grip 34 may be configured to facilitate holding the EM rifle 30 during use, and may employ pistol or substantially any other conventional or non-conventional grip technology. In one implementation, the grip 34 may take the form of a pistol grip attached to and projecting generally perpendicularly from a bottom of the body 40. The handle 36 may be configured to facilitate stabilizing or otherwise handling the EM rifle 30 during use, and may employ substantially any conventional or non-conventional handle technology. In one implementation, the handle 36 may take the form of a generally cylindrical extension attached to and projecting generally perpendicularly from a side of the body 40. Although shown adapted for hand-held use, it will be understood that the EM rifle 30 may be alternatively adapted for tripod-mounted or fixed-mount use (whether on a land, air, or sea vehicle or other location).

The trigger 38 may be configured to facilitate initiating driving (which in this embodiment means accelerating and releasing) the projectile during use, and may employ substantially any conventional or non-conventional trigger technology. In one implementation, the trigger 38 may take the form of an actuatable electrical switch associated with and supported on the grip 34. The body 40 may be configured to physically support and/or house the other components of the EM rifle 30, and may employ substantially any conventional or non-conventional body technology. In one implementation, the body 40 may take the form of a generally cylindrical housing which is elongated along a central axis A.

The core 42 may be configured to electromagnetically drive the projectile when the trigger 38 is actuated. In one implementation, the core 42 may be housed within the body 40, and may include a stator 50, an armature 52, a transfer shaft 54, a transfer plate 56, and a railed shaft 58. The stator 50 may include a stator coil of electrically conductive material, and may be configured to generate a first/leading EM field. In one implementation, the stator 50 may have the form of a generally cylindrical coil of wire positioned next to an inner surface of the body 40 and similarly elongated along the central axis A. The armature 52 may include a forward coil 60, a reverse coil 62, and first and second contact rings 64,66 of electrically conductive material, and may be configured to generate second/forward and third/reverse EM fields which interact with the first EM field to move the armature 52, forwardly and rearwardly, respectively, within the stator 52. The armature 52 may be partially enclosed within a housing 68 of non-conductive material. In one implementation, the armature 52 may have a generally cylindrical form positioned within the cylinder formed by the stator 50 and similarly elongated along the central axis A.

The transfer shaft 54 may be physically coupled with and project generally forwardly from the armature 52, and may be configured to transfer to the transfer plate 56 the driving force resulting from the forward motion of the armature 52 within the stator 50. The transfer plate 56 may be physically coupled with a forward end of the transfer shaft 54, and may be configured to transfer to the projectile the driving force resulting from the forward motion of the armature 52 within the stator 50. In one implementation, the transfer plate 56 may include a one or more mechanical structures (e.g., a plurality of plate teeth 70) configured to interlock with or otherwise engage one or more corresponding mechanical structures (e.g., a plurality of projectile teeth 72) and thereby further transfer to the projectile a spinning motion resulting from a turning motion of the armature 52 within the stator 50.

The railed shaft 58 may include an elongated central shaft or rod 74 extending through the housing along the axis A and a plurality of rails 76 configured helically around the rod 74. The central rod 74 may be constructed of non-conductive material, while the rails 76 may be constructed of conductive material. In one implementation, there may be four rails 76A,76B,76C,76D positioned equidistantly around the rod 74. In one implementation, the rod 74 and the rails 76 may have generally square cross-sections. In one implementation, the rails 76 may turn less than 170 degrees, or less than 180 degrees, about the railed shaft 58.

Referring also to FIGS. 9-12, in forward operation, an electrical current is applied to the first rail 76A and travels from the first rail 76A to a first contact point 80 for the forward coil 60, travels from the first contact point 80 to the forward coil 60, travels from the forward coil 60 to the second contact ring 66, travels from the second contact ring 66 to the stator coil 50, travels from the stator coil 50 to the first contact ring 64, travels from the first contact ring 64 to a first armature pass-through 82, and travels from the first armature pass-through 82 to the third rail 76C, thereby completing the electrical circuit. This results in the stator coil 50 generating a relatively stronger leading/first EM field, and the forward coil 60 generating a relatively weaker trailing/second/forward EM field, and the armature 52 being pulled forward as the centers of the two EM fields attempt to align.

In rearward operation, an electrical current is applied to the second rail 76B and travels from the second rail 76B to a second contact point 84 for the reverse coil 62, travels from the second contact point 84 to the reverse coil 62, travels from the reverse coil 62 to the first contact ring 64, travels from the first contact ring 64 to the stator coil 50, travels from the stator coil 50 to the second contact ring 66, travels from the second contact ring 66 to a second armature pass-through 86, and travels from the second armature pass-through 86 to the fourth rail 76D, thereby completing the electrical circuit. This results in the stator coil 50 generating a relatively stronger first/leading EM field, and the reverse coil 62 generating a relatively weaker trailing/third/reverse EM field, and the armature 52 being pulled rearward as the centers of the two EM fields attempt to align.

Referring to FIGS. 13-16, an alternative embodiment of the armature is shown including independent forward and reverse coils 60,62, wherein the forward coil 60 has its own first and second forward contact rings 60A,60B and the reverse coil 62 has its own first and second rearward contact rings 66A,66B.

Figure 18:
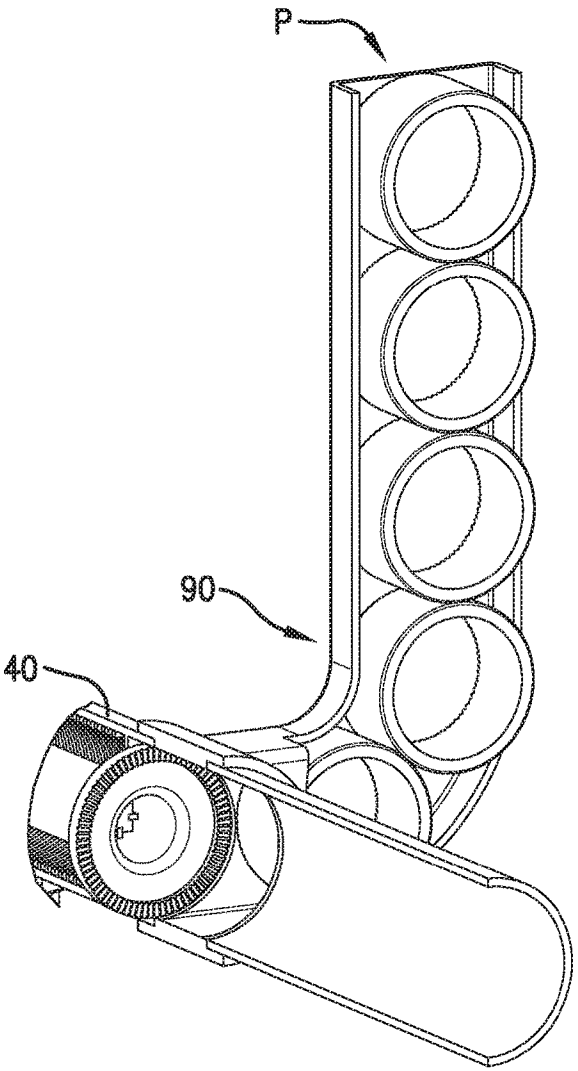
FIG. 18 is a second fragmentary rearward-looking isometric view of the EM rifle of FIG. 17 before the projectile has been loaded.
Figure 17:
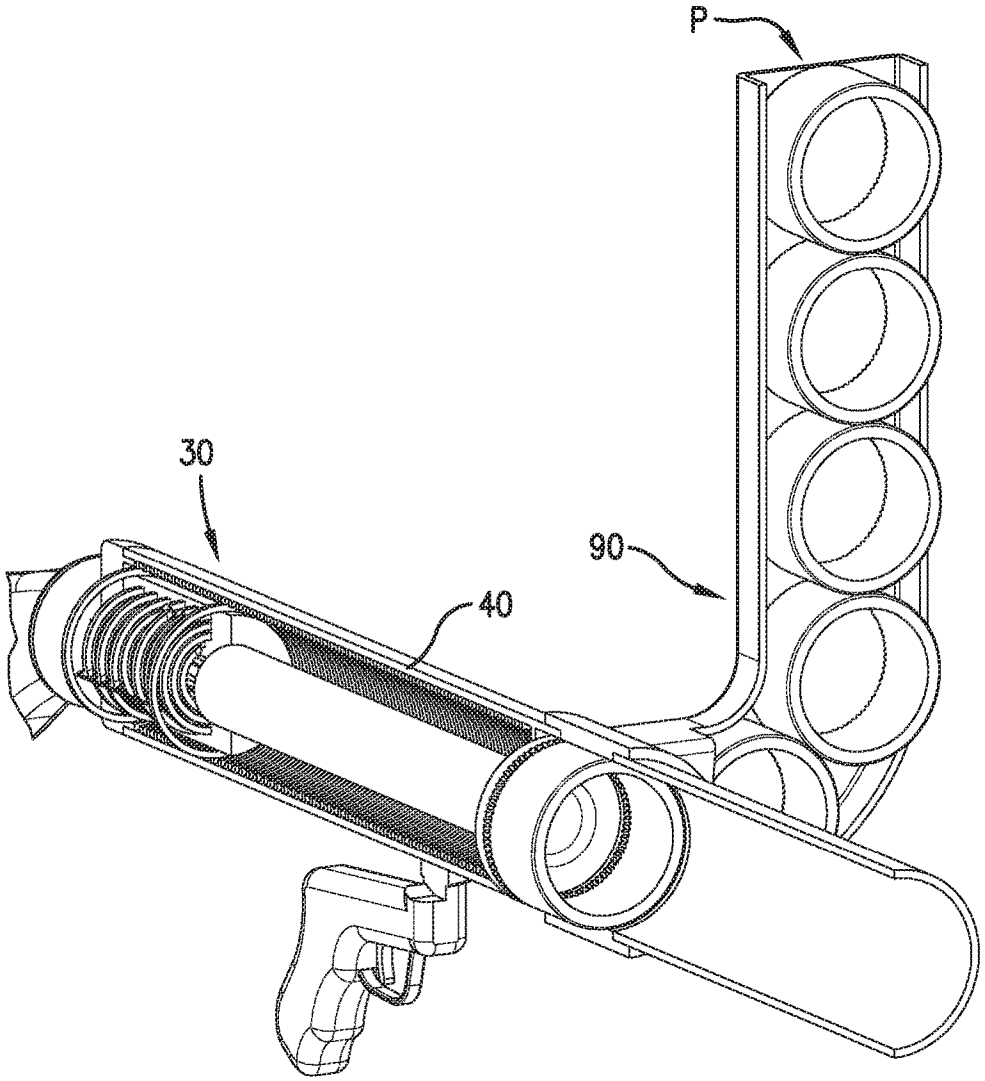
FIG. 17 is a first fragmentary rearward-looking isometric view of the EM rifle showing an embodiment of a projectile feeding mechanism after a projectile has been loaded.

Referring to FIGS. 17 and 18, an embodiment of a feed mechanism 90 is shown for storing a plurality of projectiles P and for delivering the stored projectiles P into the EM rifle 30 for acceleration and release. The feed mechanism 90 may rely on gravity to advance and deliver the stored projectiles P, and/or a spring (not shown) may exert a force on the last stored projectile P, wherein the force is transferred through each adjacent projectile P to advance and deliver the stored projectiles P. Each stored projectile P may be delivered into the EM rifle 30 via an opening in a wall of the EM rifle 30 which is uncovered when the armature 52 is fully retracted such that the transfer plate 56 is positioned to receive the projectile P.

Figure 19:
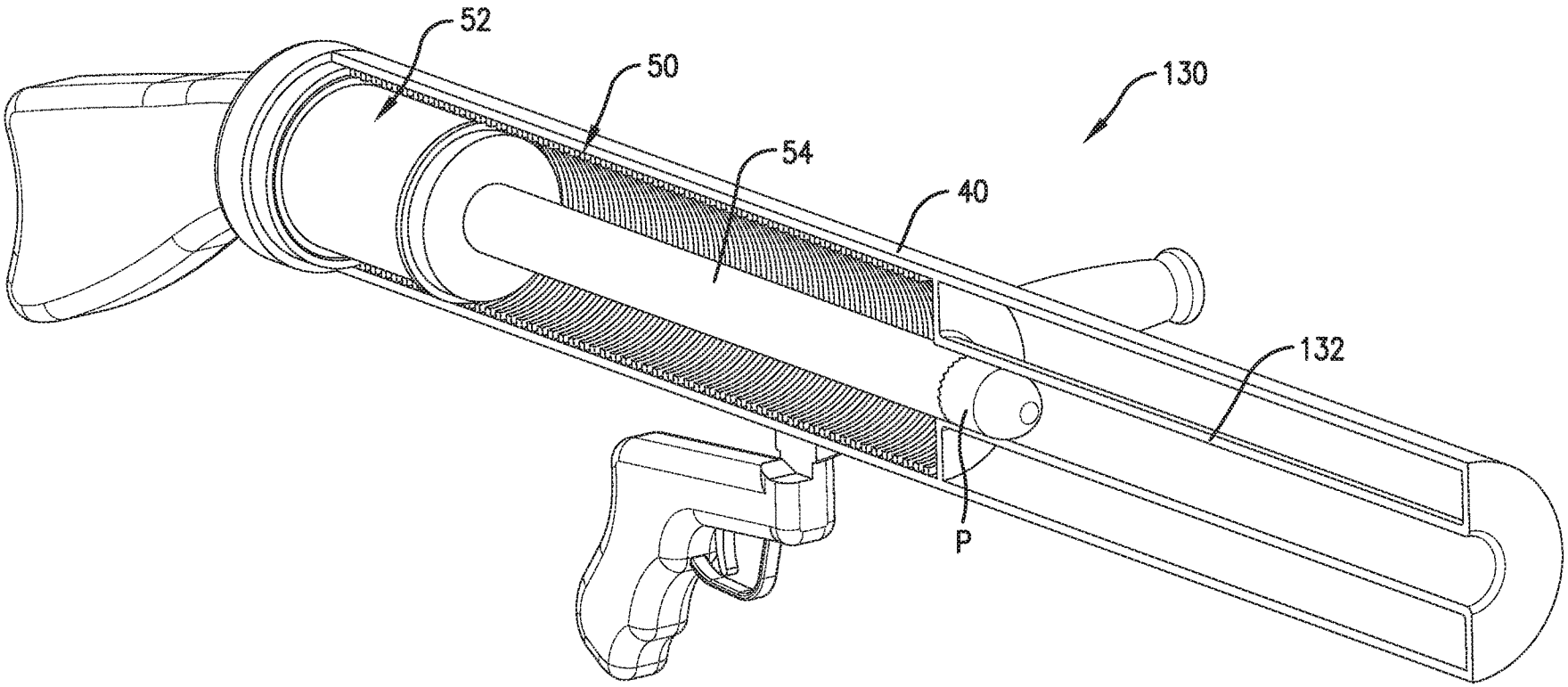
FIG. 19 is a rearward-looking partial cross-sectional isometric view of an alternative embodiment of the EM rifle shown ready to drive the projectile.
Figure 20:
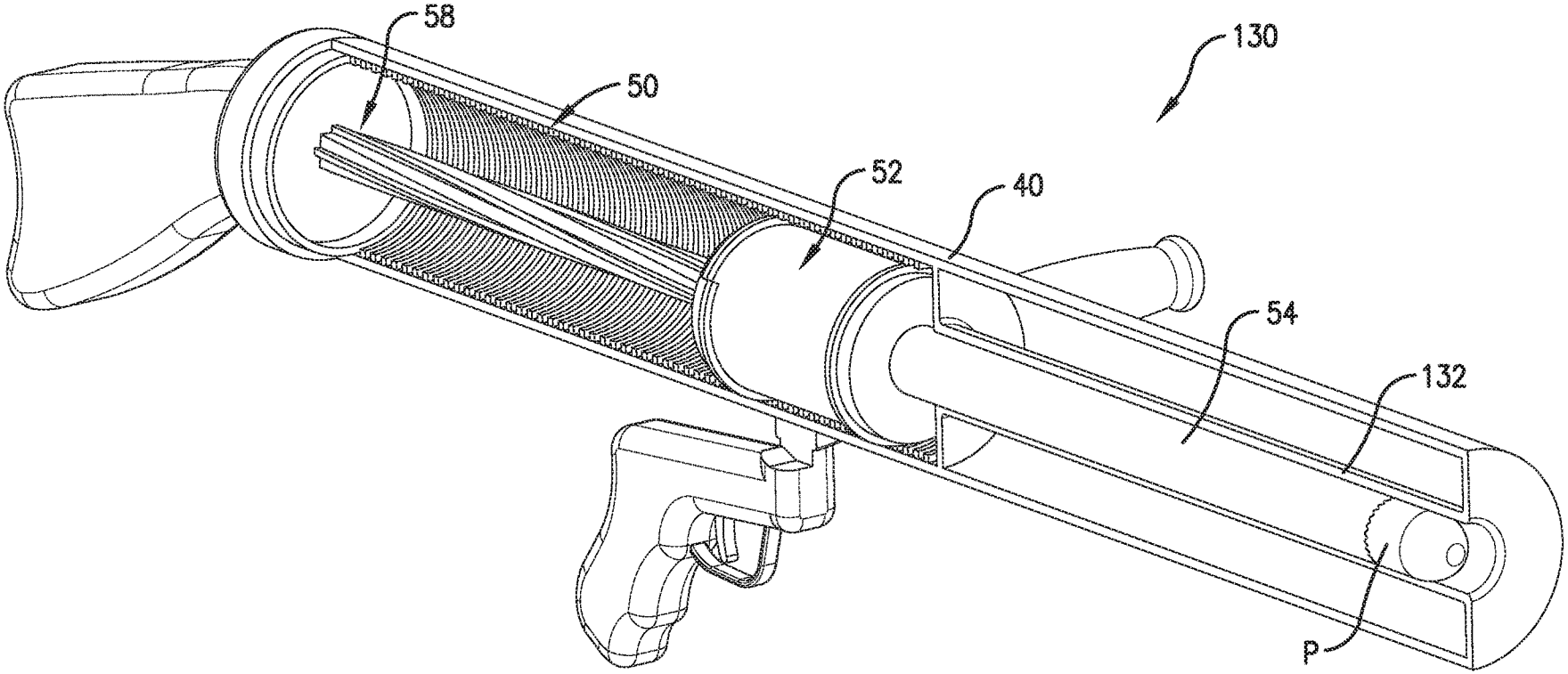
FIG. 20 is a rearward-looking partial cross-sectional isometric view of the alternative embodiment of the EM rifle of FIG. 19 shown driving the projectile.
Figure 21:
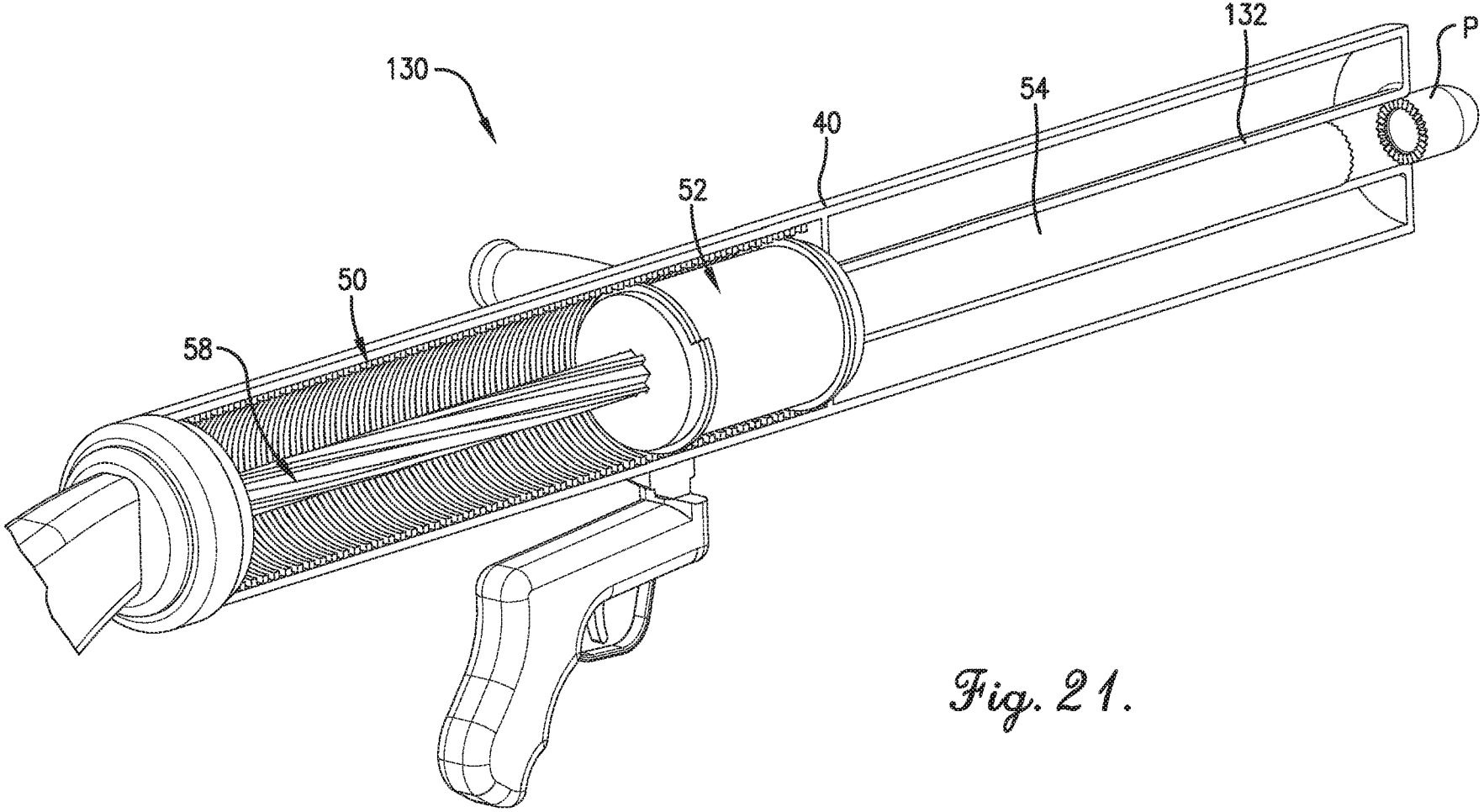
FIG. 21 is a forward-looking partial cross-sectional isometric view of the alternative embodiment of the EM rifle of FIG. 19 shown releasing the projectile.

Referring to FIGS. 19-21, an alternative embodiment of the EM rifle 132 is shown which may be substantially similar or identical to the previously-described embodiments except as follows. The EM rifle 130 may be configured to drive relatively smaller projectiles P, and may include a secondary barrel 132 positioned within the body 40 and oriented along the axis A and having a diameter or other cross-sectional shape which more closely approximates the size and shape of the relatively smaller projectile P. Further, the transfer plate may be eliminated (in which case the teeth may be provided on the end of the transfer shaft 54) or may be provided with a size and shape that more closely accommodates the projectile P and the secondary barrel 132.

In the various embodiments, an ammunition reservoir may provide a plurality of the projectiles to the EM rifle 30,130, and a power source may provide a direct current (DC) electrical current to the stator and armature coils. Referring again to FIG. 2, a backpack 232 may be provided to contain the ammunition reservoir 234 and/or power source 236, wherein the backpack 232 may be worn by a user of the EM rifle 30,130. The ammunition reservoir 232 may provide the projectiles P to be launched from EM rifle 30,130. In one implementation, the ammunition reservoir 234 may include a metal wire or cylinder of great length, such as tens of feet, that may be retained on a spool. The spool may be stored in the backpack 232 an such a way that it can rotate freely in order to feed the wire or cylinder. The spool may include an actuator, such as an electric motor, and a cutting mechanism configured to rotate the spool and thereby feed cut lengths of the wire or cylinder into the EM rifle 30,130. In another implementation, the ammunition reservoir 234 may include a plurality of metal wires or cylinders of short length, such as approximately one inch. The wires or cylinders may be retained in a feeder mechanism which can feed the pre-cut wires or cylinders one at a time into the EM rifle 30,130. In the latter implementation, the plurality of metal wires or cylinders may be embedded or contained or otherwise associated with a great length of flexible material which can be spooled, such that the spool-related features of the former implementation may be incorporated into the latter implementation as well.

The power source 236 may be configured to provide pulses of electric current to create the first, second, and third EM fields. In one implementation, the power source 236 may include a primary energy source, a primary energy-to-electrical energy conversion unit, an electrical conditioning unit, a pulse forming network, and a controller. The primary energy source may be a standalone generator of energy. Exemplary implementations of the primary energy source may include a gasoline-fueled internal combustion engine. Alternatively, the primary energy source may be a thermoelectric conversion device, a nuclear generator, a hydrogen fuel cell, a solar cell, a battery, or the like. The primary energy-to-electrical energy conversion unit may convert the energy produced by the primary energy source to electrical energy. Exemplary implementations of the primary energy-to-electrical energy conversion unit may include a generator/alternator which produces an alternating current (AC) electric voltage and/or current. With some of the possible primary energy sources, such as the hydrogen fuel cell, the solar cell, or the battery, the primary energy-to-electrical energy conversion unit may not be necessary because the output of those sources is already electrical voltage and/or current. The electrical conditioning unit may prepare the electrical output of the primary energy to electrical energy conversion unit to provide an input to the pulse forming network. Since the pulse forming network generally requires a DC electric voltage and/or current, the electrical conditioning unit may perform an AC-to-DC conversion. Thus, the electrical conditioning unit may include rectifying circuitry. The pulse forming network may generate a forward electric current pulse and a reverse electric current pulse. The amplitude and duration (time period) of the forward and reverse electric current pulses may be determined by the characteristics of the EM rifle 30,130, such as the length of the barrel down which the projectile travels and the time period for that to happen. In various implementations, the forward and reverse electric current pulses may have the same or different amplitude and duration.

It will be understood that the dimensions of the various components of the EM driver will depend on the nature of use and other practical considerations. For example, the coil lengths and turn ratios may depend on the nature of the object and the desired velocity; the strength of the materials; and the rise time, peak amplitude, and duration of the electrical pulses.

Again, although the third embodiment of an EM rifle is described herein for illustration purposes, it will be understood that present technology may be adapted for use in substantially any device or system for driving or accelerating an object, wherein the object may or may not be released at the end of the acceleration. For example, the present technology may be adapted for accelerating and releasing packages, payloads, or vehicles (whether manned or unmanned) or the present technology may be adapted for accelerating without releasing a hammer, chisel, piston or impactor.

Although the invention has been described with reference to the one or more embodiments illustrated in the figures, it is understood that equivalents may be employed and substitutions made herein without departing from the scope of the invention as recited in the claims.

Having thus described one or more embodiments of the invention, what is claimed as new and desired to be protected by Letters Patent includes the following:

1. An electromagnetic driver for accelerating an object, the electromagnetic driver comprising:

a body elongated along a central axis; and a core housed within the body and configured to accelerate the object along the central axis, the core including— a stator including a stator coil configured to generate a first electromagnetic field, an armature including a forward coil configured to generate a second electromagnetic field which interacts with the first electromagnetic field to accelerate the armature in a forward direction along the central axis, and a railed shaft elongated along the central axis and passing through the armature and including a plurality of rails arranged helically around a central shaft, wherein the forward coil remains in physical contact with one or more of the plurality of rails during acceleration of the armature in the forward direction, so as to impart a turning motion to the armature during acceleration in the forward direction.

2. The electromagnetic driver of claim 1, wherein the object is accelerated and released and is selected from the group consisting of: packages, payloads, vehicles, and projectiles.

3. The electromagnetic driver of claim 1, wherein the object is accelerated and not released and is selected from the group consisting of: hammers, chisels, impactors, and pistons.

4. The electromagnetic driver of claim 1, wherein the stator coil is a cylindrical coil of wire elongated along the central axis.

5. The electromagnetic driver of claim 1, further including a transfer shaft physically coupled with the armature and projecting forwardly therefrom along the central axis and configured to transfer to the object the acceleration of the armature in the forward direction.

6. The electromagnetic driver of claim 5, wherein a forward end of the transfer shaft includes one or more mechanical structures configured to physically engage the object and thereby further transfer to the object the turning motion of the armature.

7. The electromagnetic driver of claim 5, further including a transfer plate physically coupled with a forward end of the transfer shaft and configured to transfer to the object the acceleration of the armature and the transfer shaft in the forward direction.

8. The electromagnetic driver of claim 7, wherein the transfer plate includes one or more mechanical structures configured to physically engage the object and thereby further transfer to the object the turning motion of the armature.

9. The electromagnetic river of claim 1, further including a first contact ring at a first end of the forward coil and a second contact ring at a second end of the forward coil, wherein the first and second contact rings remain in physical contact with one or more of the plurality of rails during acceleration of the armature in the forward direction.

10. The electromagnetic driver of claim 9, wherein during a forward operation— an electrical current is applied to a first rail of the plurality of rails;

the electrical current travels from the first rail to the first contact point;

the electrical current travels from the first contact point to the forward coil;

the electrical current travels from the forward coil to the second contact ring;

the electrical current travels from the second contact ring to the stator coil;

the electrical current travels from the stator coil to the first contact ring;

the electrical current travels from the first contact ring to the armature pass-through; and the electrical current travels from the armature pass-through to a third rail of the plurality of rails, thereby completing an electrical circuit, and as a result, the armature is accelerated in the forward direction as the second electromagnetic field attempts to align with the first electromagnetic field.

11. The electromagnetic driver of claim 10, further including a reverse coil configured to generate a third electromagnetic field which interacts with the first electromagnetic field to accelerate the armature in a rearward direction along the central axis.

12. The electromagnetic driver of claim 11, wherein during a rearward operation— the electrical current is applied to a second rail of the plurality of rails;

the electrical current travels from the second rail to the second contact point;

the electrical current travels from the second contact point to the reverse coil;

the electrical current travels from the reverse coil to the first contact ring;

the electrical current travels from the first contact ring to the stator coil;

the electrical current travels from the stator coil to the second contact ring;

the electrical current travels from the second contact ring to the armature pass-through; and the electrical current travels from the armature pass-through to a fourth rail of the plurality of rails, thereby completing the electrical circuit, and as a result, the armature is accelerated in the rearward direction as the third electromagnetic field attempts to align with the first electromagnetic field.

13. The electromagnetic driver of claim 1, further including— first and second forward contact rings electrically connected to the forward coil, wherein the first and second forward contact rings remain in physical contact with one or more of the plurality of rails during acceleration of the armature in the forward direction; and first and second rearward contact rings electrically connected to the reverse coil, wherein the first and second rearward contact rings remain in physical contact with one or more of the plurality of rails during acceleration of the armature in the rearward direction.

14. An electromagnetic driver for accelerating and releasing an object, the electromagnetic driver comprising:

a body elongated along a central axis;

a core housed within the body and configured to accelerate the object along the central axis, the core including— a stator including a stator coil configured to generate a first electromagnetic field, wherein the stator coil is a cylindrical coil of wire elongated along the central axis, an armature configured to move within the stator coil and including a forward coil configured to generate a second electromagnetic field which interacts with the first electromagnetic field to accelerate the armature in a forward direction along the central axis, and a railed shaft elongated along the central axis and passing through the armature and including a plurality of rails arranged helically around a central shaft, wherein the forward coil remains in physical contact with one or more of the plurality of rails during acceleration of the armature in the forward direction, so as to impart a turning motion to the armature during acceleration in the forward direction; and a transfer shaft physically coupled with the armature and projecting forwardly therefrom along the central axis and configured to transfer to the object the acceleration of the armature in the forward direction.

15. The electromagnetic driver of claim 14, wherein the object is selected from the group consisting of: packages, payloads, vehicles, and projectiles.

16. The electromagnetic driver of claim 14, further including a first contact ring at a first end of the forward coil and a second contact ring at a second end of the forward coil, wherein the first and second contact rings remain in physical contact with one or more of the plurality of rails during acceleration of the armature in the forward direction.

17. The electromagnetic driver of claim 16, wherein during a forward operation— an electrical current is applied to a first rail of the plurality of rails;

the electrical current travels from the first rail to the first contact point;

the electrical current travels from the first contact point to the forward coil;

the electrical current travels from the forward coil to the second contact ring;

the electrical current travels from the second contact ring to the stator coil;

the electrical current travels from the stator coil to the first contact ring;

the electrical current travels from the first contact ring to the armature pass-through; and the electrical current travels from the armature pass-through to a third rail of the plurality of rails, thereby completing an electrical circuit, and as a result, the armature is accelerated in the forward direction as the second electromagnetic field attempts to align with the first electromagnetic field.

18. The electromagnetic driver of claim 17, further including a reverse coil configured to generate a third electromagnetic field which interacts with the first electromagnetic field to accelerate the armature in a rearward direction along the central axis.

19. The electromagnetic driver of claim 18, wherein during a rearward operation— the electrical current is applied to a second rail of the plurality of rails;

the electrical current travels from the second rail to the second contact point;

the electrical current travels from the second contact point to the reverse coil;

the electrical current travels from the reverse coil to the first contact ring;

the electrical current travels from the first contact ring to the stator coil;

the electrical current travels from the stator coil to the second contact ring;

the electrical current travels from the second contact ring to the armature pass-through; and the electrical current travels from the armature pass-through to a fourth rail of the plurality of rails, thereby completing the electrical circuit, and as a result, the armature is accelerated in the rearward direction as the third electromagnetic field attempts to align with the first electromagnetic field.

* * * * *